US007841691B2

(12) United States Patent
Yamada

(10) Patent No.: US 7,841,691 B2
(45) Date of Patent: Nov. 30, 2010

(54) IMAGE FORMING APPARATUS EQUIPPED WITH MAINTENANCE MECHANISM

(75) Inventor: Takahisa Yamada, Hachioji (JP)

(73) Assignee: Olympus Corporation, Tokyo (JP)

( * ) Notice: Subject to any disclaimer, the term of this patent is extended or adjusted under 35 U.S.C. 154(b) by 431 days.

(21) Appl. No.: 12/077,293

(22) Filed: Mar. 18, 2008

(65) Prior Publication Data

US 2008/0231655 A1 Sep. 25, 2008

(30) Foreign Application Priority Data

Mar. 19, 2007 (JP) ..... 2007-071253

(51) Int. Cl.
*B41J 2/165* (2006.01)

(52) U.S. Cl. ..... 347/29; 347/30

(58) Field of Classification Search ..... 347/20–36, 347/42, 108

See application file for complete search history.

(56) References Cited

U.S. PATENT DOCUMENTS 7,399,056 B2 * 7/2008 Nakashima et al. ..... 347/29

FOREIGN PATENT DOCUMENTS

JP 9-141880 A 6/1997

* cited by examiner

*Primary Examiner*—Stephen D Meier
*Assistant Examiner*—Geoffrey Mruk
(74) *Attorney, Agent, or Firm*—Holtz, Holtz, Goodman & Chick, PC

(57) ABSTRACT

The image forming apparatus is an image forming apparatus equipped with a maintenance mechanism that is divided into a plurality of ink pans, which are connected to each other at an edge of each of which by means of pins, on a bottom surface of each of which a plurality of caps are arranged, which at the time of storage, are stored from guide rails so as to be stored at a position beneath a conveyance path in a V-shaped state, the caps in the ink pans being opposed to each other in a V-shaped state, which are drawn out horizontally along the guide rails to a position beneath the recording head group, and in each of which the caps are allocated to the nozzle surfaces of the recording heads by a hoisting and lowering operation of a belt conveying unit.

12 Claims, 17 Drawing Sheets

IMAGE FORMING APPARATUS EQUIPPED WITH MAINTENANCE MECHANISM

CROSS-REFERENCE TO RELATED APPLICATIONS

This application is based upon and claims the benefit of priority from prior Japanese Patent Application No. 2007-071253, filed Mar. 19, 2007, the entire contents of which are incorporated herein by reference.

BACKGROUND OF THE INVENTION

1. Field of the Invention

The present invention relates to an image forming apparatus equipped with a maintenance mechanism which is used for maintaining a line head, and is folded to be stored.

2. Description of the Related Art

Heretofore, in an image forming apparatus, for example, an inkjet printer, for forming an image by ejecting a plurality of colored inks toward a recording medium, a maintenance mechanism is provided in order to protect a recording head and prevent a nozzle from clogging or restore the clogged nozzle to its original state.

The image forming apparatus is roughly classified into a type in which an image is formed by scan-moving a recording head with respect to a recording medium, and a type in which an image is formed by causing a fixed recording head to eject ink toward a recording medium being conveyed. The fixed-head type image forming apparatus usually incorporates a line recording head having a length spanning the entire width of a recording medium. Hence, with an increase in the size of the recording medium, the length of the line recording head becomes longer. In order to perform maintenance of a large-sized line recording head, a similarly large-sized maintenance mechanism is therefore needed.

The maintenance mechanism is normally present at either one of a maintenance processing position, at which maintenance is performed in contact with or in close vicinity to the recording head, and a maintenance retraction position, at which the maintenance mechanism is retracted during the recording time during which the recording head is driven. Accordingly, a space in which the retracted maintenance mechanism is to be stored is needed, and hence if the maintenance mechanism is large-sized, the entire apparatus or the installation area also becomes large.

In order to cope with this problem, in, for example, Jpn. Pat. Appln. KOKAI Publication No. 9-141880, a technique is disclosed in which a cap member constituted of a flexible sheet of an elastic member for sealing the ejection surface of the recording head is fixed to a foldable base plate and, when the maintenance mechanism is retracted, the base plate is folded and the cap is deformed, thereby accommodating the maintenance mechanism therein. As described above, the maintenance mechanism is accommodated in a small space, whereby reduction in the conveyance path length in the paper conveying direction, downsizing of the apparatus, and reduction in the installation area are realized.

The maintenance mechanism is, in the retracted state at the time of image formation, deformed into a U-shape together with the base plate and the cap member. That is, while the image forming apparatus is in the image forming state, the cap member is held in the folded state. Hence, there is the possibility that a gap due to a folding effect or creases may occur at the cap member, therefore attention needs to be paid to lowering of the degree of tightness of the seal of the ejection surface of the recording head, while also preventing seepage of ink.

BRIEF SUMMARY OF THE INVENTION

An embodiment according to the present invention provides an image forming apparatus equipped with a maintenance mechanism comprising: a recording head group formed by arranging a plurality of recording heads in a first direction; an ink supply route for supplying ink to the recording head group; a plurality of sealing members to be in contact with nozzle surfaces in each of which an ink ejection nozzle of each of the recording heads is formed, and arranged in the first direction; a holding member for holding the plural sealing members; and a recording medium conveying mechanism for conveying a recording medium on a conveyance path in a state where the mechanism is opposed to the recording head group, wherein the holding member is configured to be able to be moved in a retraction direction between a sealing position at which the sealing members seal the nozzle surfaces, and a retraction position at which the holding member is stored beneath the conveyance path so as to be stored, the holding member can be folded at a position or positions between the plural sealing members, the holding member is in an expanded state at the sealing position, and the holding member is in a folded state at the retraction position.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiments of the present invention will be described below in detail with reference to the accompanying drawings.

Figure 1:
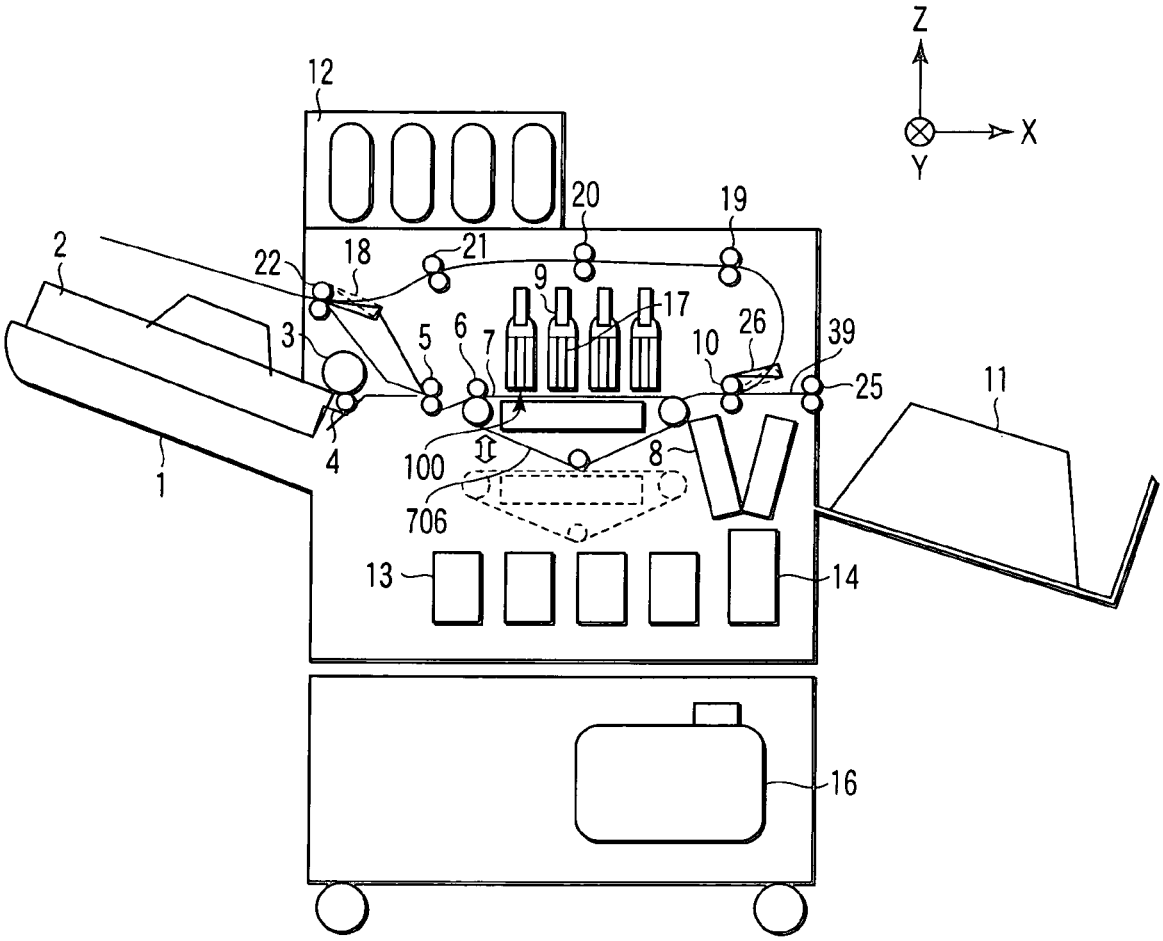
FIG. 1 is a view showing a conceptual configuration of the entire image forming apparatus according to a first embodiment.

FIG. 1 shows a conceptual configuration of the entire image forming apparatus according to a first embodiment.

In the following drawings, a conveying direction of a recording medium in the image forming apparatus is made the X-axis direction or the sub-scanning direction, and a direction perpendicular to the conveying direction is made the Y-axis direction or the main scanning direction, i.e., the width direction of the recording medium. A direction perpendicular to both the X-axis and the Y-axis is made the Z-axis direction or the vertical direction.

The image forming apparatus is basically composed of a recording medium supply mechanism, a conveying mechanism, an image forming mechanism, a maintenance mechanism, and a recording medium accommodation mechanism.

First, the recording medium supply mechanism will be described below. On a paper feed tray 1, a plurality of recording media 2 are placed, and a distal end thereof is pressed against a paper feed roller 3 by a biasing means (not shown). Further, a separation roller 4 for separately feeding recording media one by one is pressed against the paper feed roller 3. The paper feed roller 3 and the separation roller 4 are each formed to have a cylindrical shape, and are close to each other in the longitudinal direction (or the generatrix direction). While the paper feed roller 3 is rotated in the recording medium conveying direction, the separation roller 4 is rotated in the direction reverse to that of the paper feed roller 3 through a torque limiter. On the downstream side in the conveying direction, resist roller pair 5 are arranged.

The resist roller pair 5 are repeatedly rotated and stopped by a driving mechanism, not shown, to cause the front edge of a sheet of recording media to abut against and align with a nip of the resist roller pair 5. Immediately thereafter, the rotation driving of the resist roller pair 5 is resumed, whereby the recording media are lined up, and are conveyed to the downstream side in the conveying direction. A belt conveying unit 7 is arranged on the downstream side.

Next, the image forming mechanism will be described below.

Figure 2:
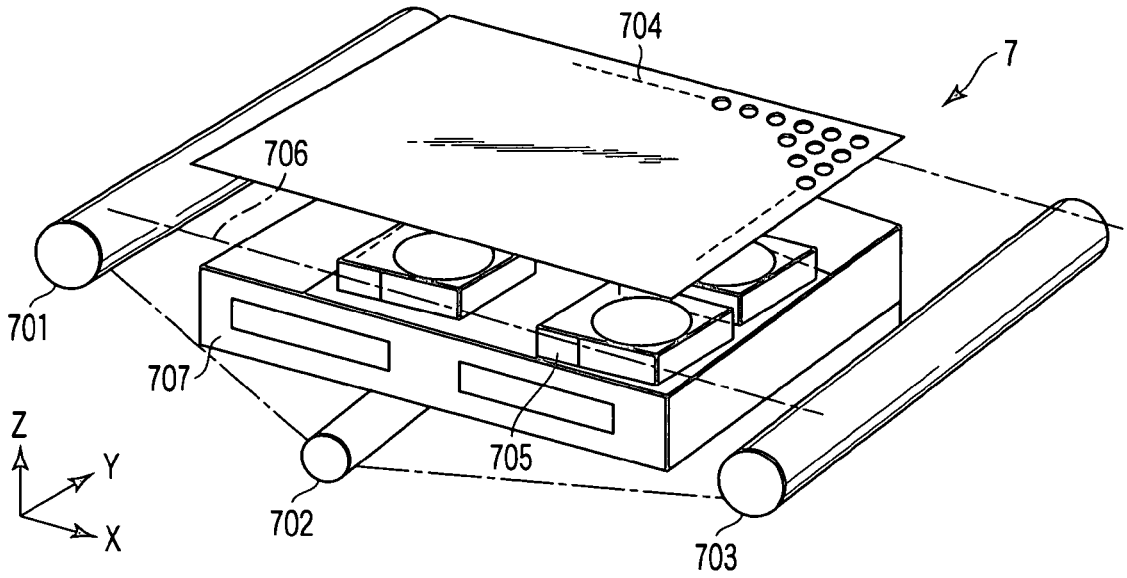
FIG. 2 is a view showing the configuration of a conveying mechanism constituted of a belt platen and an endless belt.

The belt conveying unit 7 is held so as to be ascendable and descended in the arrow directions in FIG. 1 by a hoisting and lowering mechanism (not shown). The belt conveying unit 7 is configured, as shown in FIG. 2, such that an endless belt 706 made of rubber is spanned from a driving roller 701 to a driven roller 703. Further, the belt conveying unit 7 is configured such that a tension roller 702 tensions the endless belt 706. A chamber 707 forming a box-like space is arranged inside the endless belt 706, and a plurality of suction fans 705 are arranged inside the chamber 707. Further, a flat platen 704 in which a large number of through-holes are formed is attached to one surface of the chamber 707 on the suction side of the suction fans 705. The platen 704 supports the spanned endless belt 706 from the backside, and is arranged in such a manner that nozzle surfaces 100 of a recording head group 17 opposed to the platen 704 and a recording medium conveying surface formed by the endless belt 706 are parallel with each other with a gap of about 1 mm formed between them.

A large number of holes are also formed in the endless belt 706. As a result, the suction fans 705 suck in air through the holes of the endless belt 706 and the holes of the platen 704 to the inside of the chamber 707. By virtue of the negative pressure, a function of sticking the recording medium 2 to the surface of the endless belt 706 is carried out.

Next, the recording medium accommodation mechanism will be described below.

A conveying roller pair 10, and a paper ejection roller pair 25 are arranged on the downstream side in the conveying direction of the above-mentioned belt conveying unit 7. Further, a paper output tray 11 for receiving and accommodating the ejected recording media 2 is provided outside the apparatus on the downstream side in the conveying direction of the paper ejection roller pair 25. The recording medium 2 delivered from the belt conveying unit 7 is then accommodated in the paper output tray 11 through the conveying roller pair 10 and the paper ejection roller pair 25.

A path switching gate 26 is swingably arranged between the conveying roller pair 10 and the paper ejection roller pair 25 so as to be swingable around an end thereof and, it can be selected whether the conveyance path is to be guided to the paper ejection roller pair 25 side or to a both surface conveyance path by the switching. The both surface conveyance path is provided so as to convey the recording medium by means of roller pairs 19, 20, 21, and 22. The roller pair 22 can be rotated in both the forward and reverse directions. After a rear edge of the recording medium passes a gate 18 arranged in the same manner as the gate 26, the gate 18 is switched to the other position, and the roller pair 22 are rotated in the reverse direction, whereby the conveying direction is switched to the reverse direction and the recording medium is conveyed toward the resist roller pair 5 again. The surface of the belt 706 of the belt conveying unit 7 is arranged in such a manner that the belt 706 surface is flush with the conveying surface formed by the nip tangential lines of the resist roller pair 5 and the roller pair 10. A pinch roller 6 rides on the driving roller 701 from right above the roller 701 with its own weight, thereby performing a function of bringing the recording medium into close contact with the belt 706.

Next, the image forming mechanism will be described below.

Figure 3:
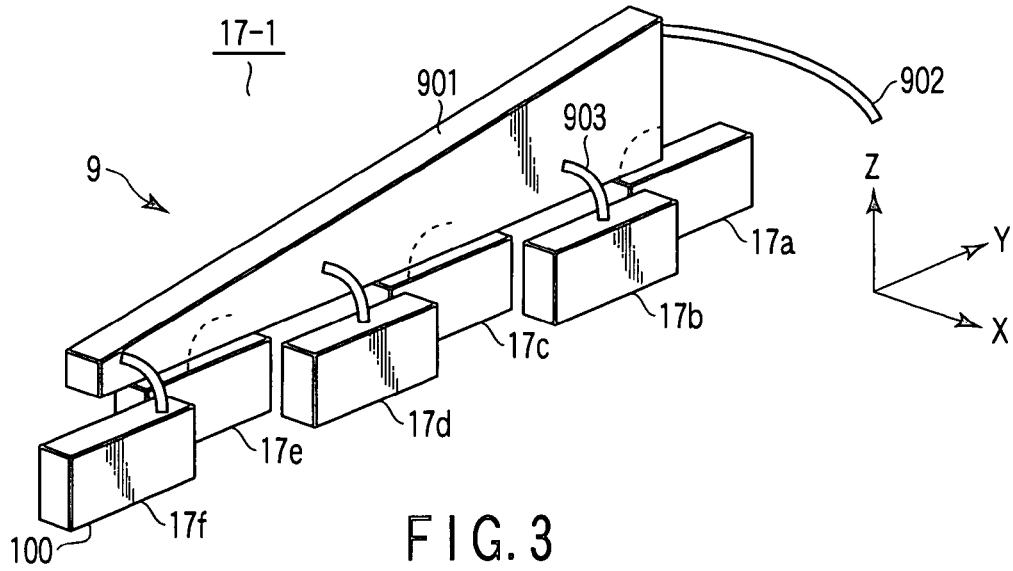
FIG. 3 is a view showing a configuration example of an ink supply system of a recording head module.

In the recording head group 17 of this embodiment, for example, recording heads 17-1K (black), 17-1C (cyan), 17-1M (Magenta), and 17-1Y (yellow) of four colors are arranged in the order in the conveying direction of the recording medium. As shown in FIG. 3, each of the recording heads 17-1K, 17-1C, 17-1M, and 17-1Y is constituted of six recording head modules. In this embodiment, as shown in FIG. 3, for example, in a recording head 17-1 that ejects ink of one color, six recording head modules 17*a* to 17*f* are arranged in a staggered configuration. In this arrangement, each of the recording head modules 17*a* to 17*f* is arranged in such a manner that a part of a nozzle array at both ends of each recording head module capable of recording overlaps each other in the recording medium conveying direction. Further, an ink supply route 9 for supplying ink to each of the recording head modules 17*a* to 17*f* is provided above the recording head modules 17*a* to 17*f*. A common ink supply route 901 and each of the recording head modules are coupled to each other by a tube 903, whereby ink is distributed/supplied to each of the recording head modules 17*a* to 17*f*. Although not shown, the common ink supply route 901 is connected to a sub-tank 13 of each color so that ink can be supplied from the sub-tank 13 to the common ink supply route 901 through a tube 902.

As described previously, the nozzle surface 100 in which a nozzle array of the recording head group 17 for ejecting ink is formed is arranged in such a manner that the ink ejecting direction is perpendicular to the surface of the endless belt 706, and a gap of about 1 mm is held between the nozzle surface 100 and the surface of the endless belt 706.

Figure 4:
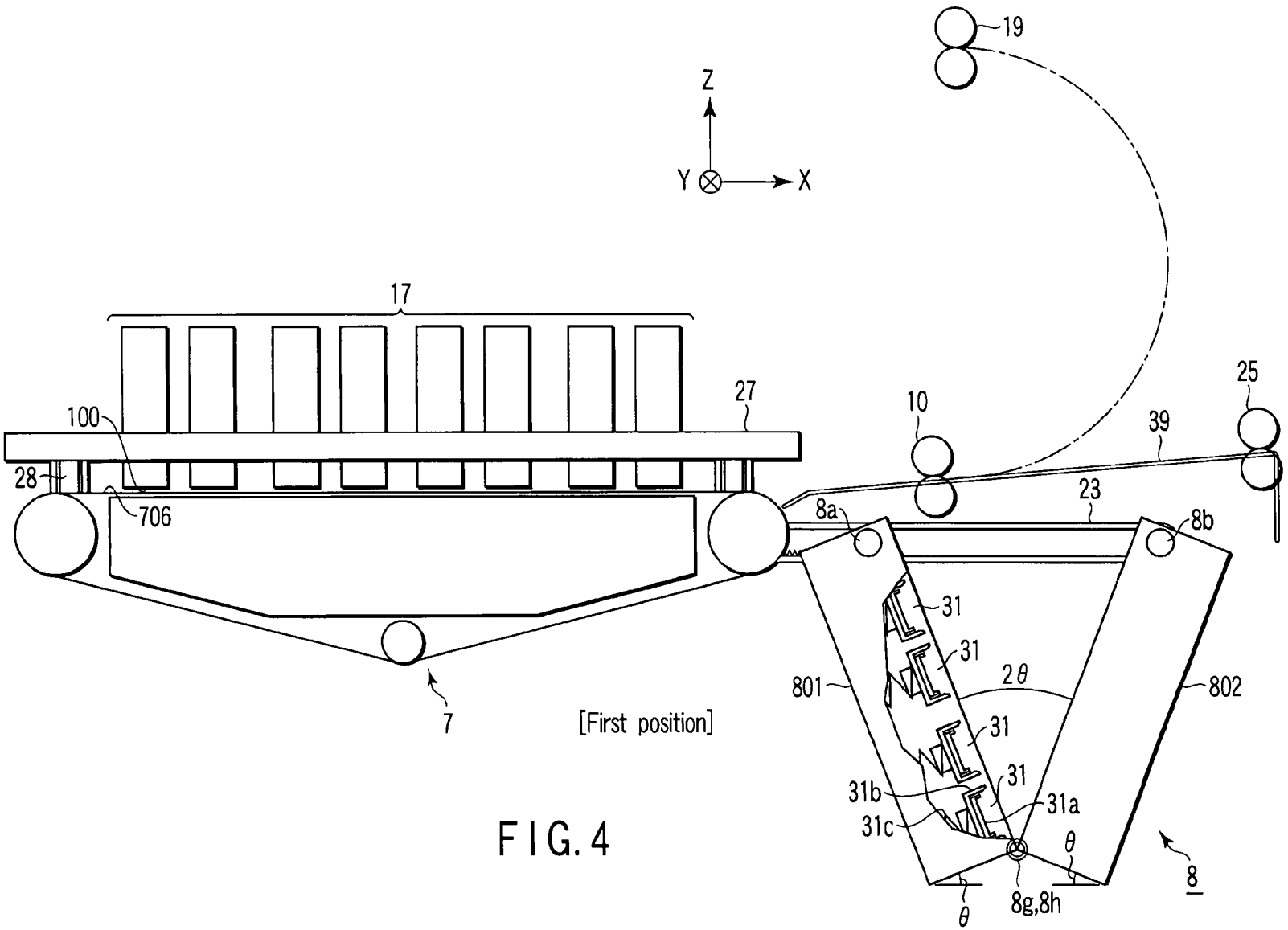
FIG. 4 is a view for explaining a "first position" of an operation of a maintenance mechanism.

The recording head group 17 is attached to a head mount 27 as shown in FIG. 4. The recording head group 17 is attached to the head mount 27 in such a manner that the recording head group is protruded from the head mount 27 so as to allow the nozzle surfaces 100 to be opposed to the recording medium 2 from the holes of the head mount.

Next, the maintenance mechanism will be described below.

Figure 5:
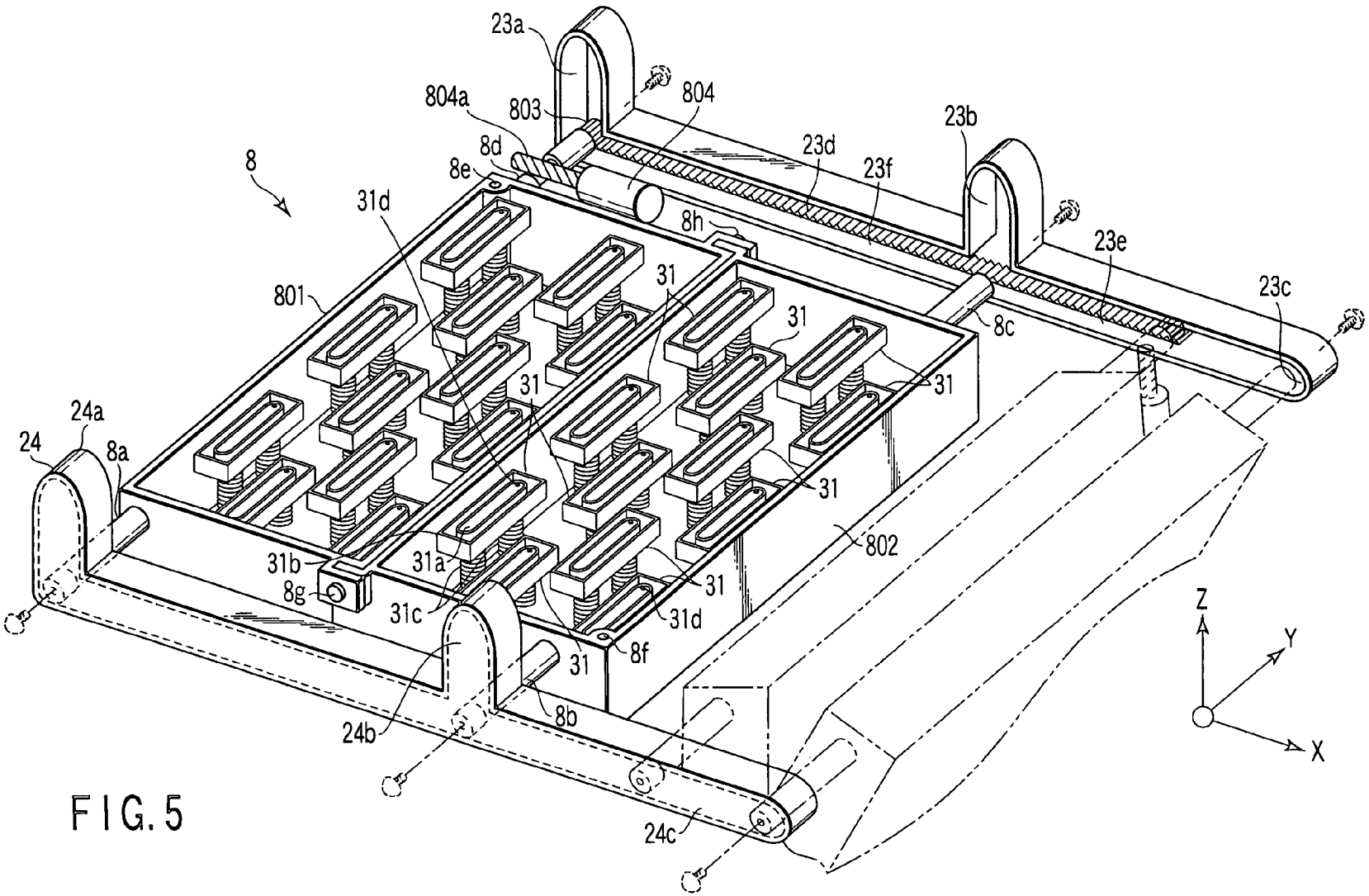
FIG. 5 is a view showing a configuration example of a head maintenance unit according to the first embodiment.

FIG. 5 shows the configuration of the head maintenance unit 8. The head maintenance unit 8 is constituted by coupling two ink pans 801 and 802 each having a tray-like shape (a shallow rectangular tray-like shape having an edge) to each other by hinged fulcrums 8*g* and 8*h*. Each of these ink pans 801 and 802 is formed into a box-like shape which is opened on the surface side opposed to the recording head group 17, and is constituted of a rectangular bottom section and a side-wall surrounding the bottom section. Pins 8*a* to 8*d* protrude in the width direction of the recording medium at corner parts farther from the hinged fulcrums 8*g* and 8*h*. The ink pans 801 and 802 are formed by using a material such as a resin or the like which is impermeable to ink, and is light in weight.

Figure 6A:
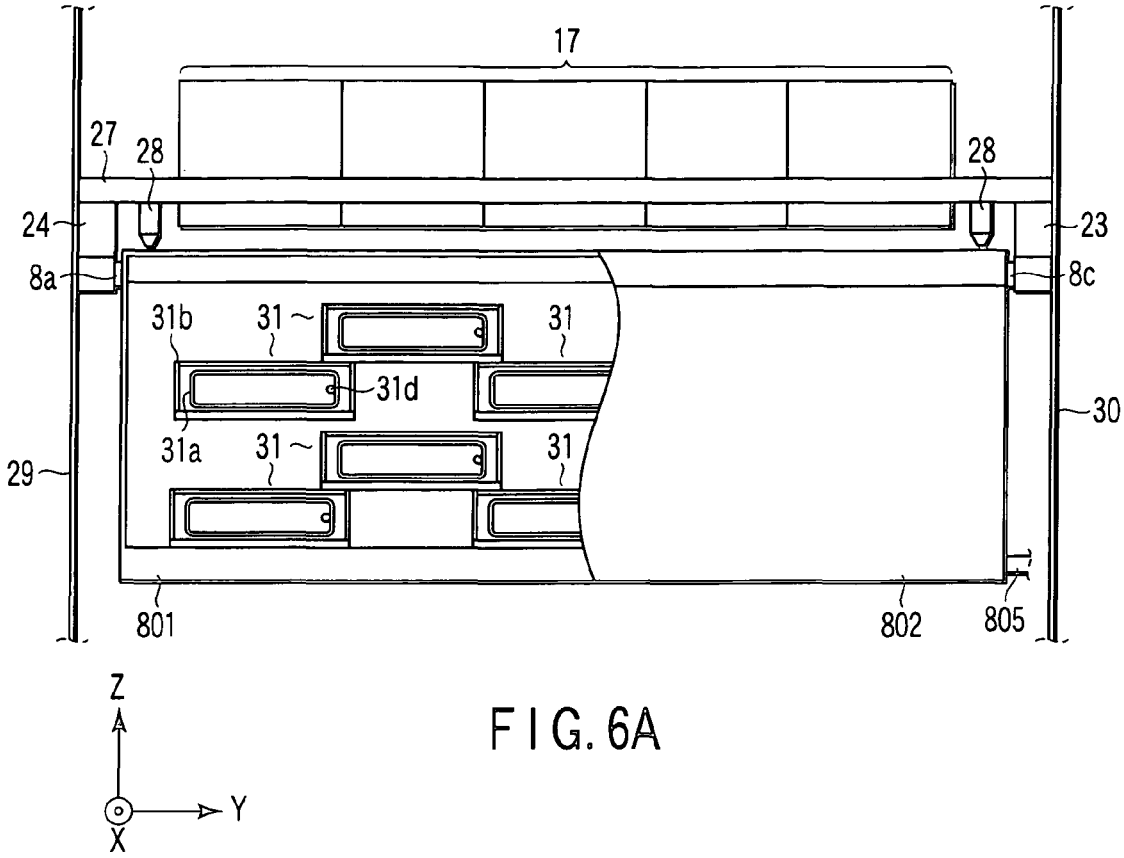
FIG. 6A is a view showing a configuration of a recording head group and the maintenance unit viewed from the paper ejection roller side.
Figure 6B:
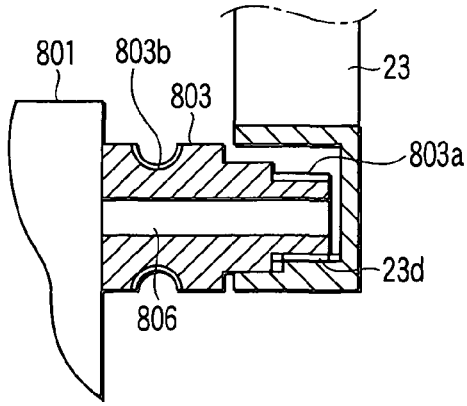
FIG. 6B is a cross-sectional view showing an engagement configuration of a guide rail and an ink pan in FIG. 6A.
Figure 7:
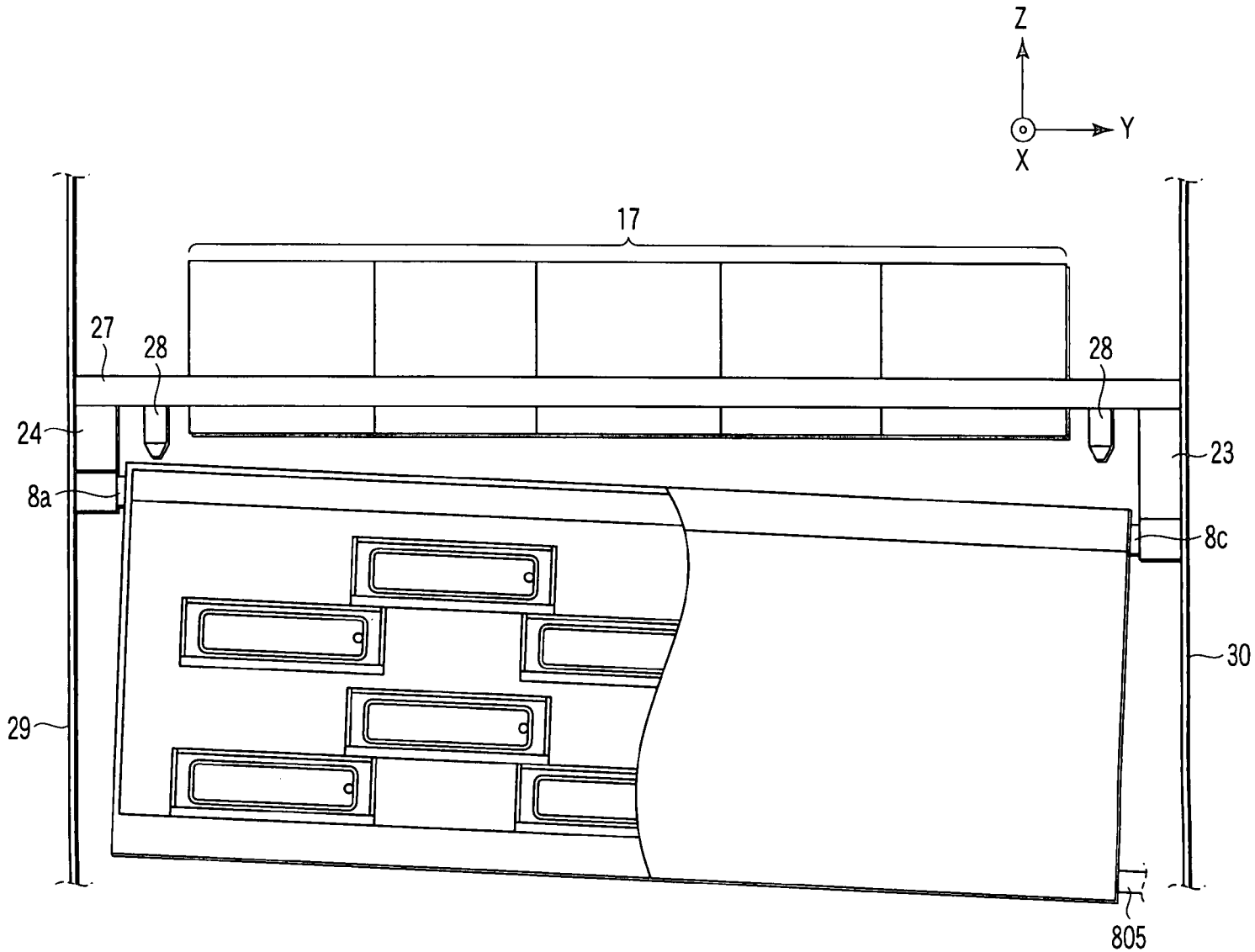
FIG. 7 is a view showing a modification example of the configuration shown in FIG. 6A.

As shown in FIGS. 6A, 6B, and 7, each of guide rails 23 and 24 is fixed to the inside of each of a frame 29 and a frame 30, which are frames of the image forming apparatus, by means of screws. In each guide rail 23 or 24, a groove 23*f* or 24*f* having a substantially F-shape is formed on the inner side thereof, and two grooves 23*a* and 23*b*, or 24*a* and 24*b* extending upwardly from the horizontal groove 23*e* or 24*e* are formed. The pin 8*d* provided so as to be protruded from the ink pan 801 is configured such that a rotatable gear 803 is provided on a shaft 806 (FIG. 6B). A pinion section 803*a* to be engaged with a rack 23*d* is formed at a distal end part of the gear 803, and a worm wheel section 803*b* is formed at a proximal part of the gear 803. Further, the pinion section 803*a* and the worm wheel section 803*b* of the gear 803 are formed integral with each other (rack and pinion mechanism). These are formed by using a hard metallic material such as stainless steel.

The worm wheel section 803*b* is engaged with a worm gear 804*a* of a motor 804 fixed to the ink pan 801, and the gear 803 can be rotated in both the forward and reverse directions by the drive of the motor 804. Incidentally, in this embodiment, the motive power of the motor 804 is transmitted by means of the worm gear 804*a*, but the transmission of the motive power is not limited to this, and a gear of the other shape may be used, or a chain or a belt can be used if the direction of the motor is taken into consideration. Further, in place of the motor 804, gear 803, and rack 23*d*, another configuration can be adopted. For example, a linear motor may be used. However, the mechanism is configured so as to enable the gear 803 to secede from the rack 23*d* at the position of the groove 23*a*.

As shown in FIGS. 5 and 6B, in the groove 23*f*, the rack 23*d* is not formed at the entrance part of the groove 23*d*, and the rack 23*d* is formed on the inner wall surface of the lower part thereof. A part of the gear 803 on which the pinion section 803*a* is not formed abuts on the part of the inner wall of the groove 23*f* where the rack 23*d* is not formed, and is held by the inner wall of the groove 23*f*. The pinion section 803*a* at the distal end of the gear 803 is engaged with the rack 23*d*. Likewise, the pin 8*c* protruding from the ink pan 802 is also supported by the part of the groove 23*f* where the rack 23*d* is not formed. No rack is formed on the guide rail 24 side. The pins 8*a* and 8*b* protruding from the ink pans 801 and 802, respectively are supported by the groove 24*f*.

Further, as shown in FIG. 5, the ink pans 801 and 802 are designed in such a manner that in the state where the ink pans 801 and 802 are opened around the hinged fulcrums 8*g* and 8*h*, the distance between the pins 8*d* and 8*c*, and the distance between the upwardly extending salient groove sections 23*a* and 23*b* are equal to each other. Likewise, the ink pans 801 and 802 are designed in such a manner that the distance between the pins 8*a* and 8*b*, and the distance between the salient groove sections 24*a* and 24*b* are equal to each other. By virtue of this structure, when the ink pans 801 and 802 are elevated, the pins 8*d* and 8*c* can be moved within the salient grooves 23*a* and 23*b*, respectively, and the pins 8*a* and 8*b* can be moved within the salient grooves 24*a* and 24*b*, respectively. Further, the ink pans 801 and 802 are biased in the direction (the state shown in FIG. 5) in which the ink pans 801 and 802 are rotated to be opened with the hinged fulcrums 8*g* and 8*h* being the center by a torsion coil spring (not shown).

On the bottom surface of the ink pans 801 and 802, a plurality of caps 31 are provided so as to be correspondent to the positions of the recording head modules 17*a* to 17*f*. In this embodiment, the caps 31 for sealing the nozzle surfaces 100 of the recording heads 17-1K (black) and 17-1C (cyan) are arranged in the ink pan 801. Further, the caps 31 for sealing the nozzle surfaces 100 of the recording heads 17-1M (magenta) and 17-1Y (yellow) are arranged in the ink pan 802. Accordingly, when the ink pans 801 and 802 are turned to be closed with the hinged fulcrums 8*g* and 8*h* being the center, the ink pans 801 and 802 are folded such that the cap 31 for sealing the nozzle surface 100 of the recording head 17-1C, and the cap 31 for sealing the nozzle surface 100 of the recording head 17-1M are opposed to each other.

Figure 8:
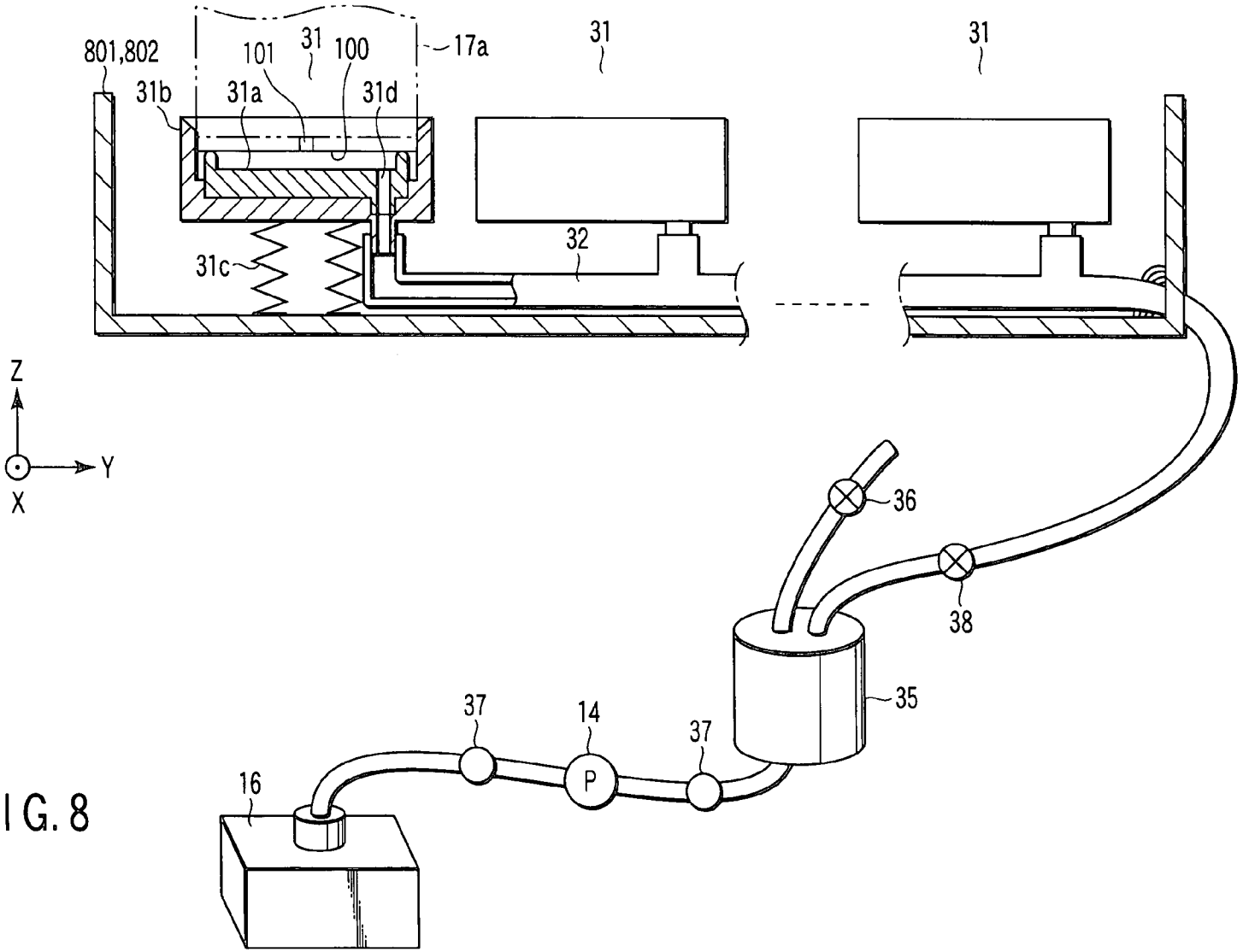
FIG. 8 is a view showing a configuration example of an ink collection mechanism.

Each of the caps 31 is constituted of, as shown in FIG. 8, a rubber piece 31*a* which is brought into direct contact with the nozzle surface 100 of each of the recording head modules 17*a* to 17*f*, and seals a part around the nozzle hole 101, a guide 31*b* for holding the rubber piece 31*a*, and positioning the rubber piece 31*a* at a periphery of each of the recording head modules 17*a* to 17*f*, and a spring 31*c* for biasing the guide 31*b* toward each of the recording head modules 17*a* to 17*f*. The plural caps 31 are arranged at positions directly facing the positions of the recording head modules in the state where the ink pans 801 and 802 are opened as shown in FIG. 5.

The guide 31*b* is made of a resin, and a tapered projection protrudes toward the recording head modules 17*a* to 17*f* side so as to be closer to them than the rubber piece 31*a*. The projection is fitted on the periphery of each of the recording head modules 17*a* to 17*f*, thereby positioning the rubber piece 31*a* at a position covering the periphery of each of the recording head modules 17*a* to 17*f*.

As shown in FIGS. 6 and 8, a suction hole 31*d* for causing the inside of the rubber piece 31*a* serving as a sealing section for covering each of the recording head modules 17*a* to 17*f* to communicate with the outside of the cap 31 is provided at an end of the rubber piece 31*a* in the longitudinal direction on the frame 30 side. The plural suction holes 31*d* are coupled to each other by means of a coupling member 32 below the guides 31*b*. Further, the coupling member 32 is drawn out from the side surface of each of the ink pans 801 and 802 to the outside, and is coupled to a buffer 35 through a valve 38. The buffer 35 has therein a space that can be tightly sealed and is filled with an air atmosphere. A tube and a valve 36 for causing the inside of the coupling member 32 and the inside of the buffer 35 to open to the atmosphere are provided on the upper part of the buffer 35. When the valve 36 is opened, the inside of the buffer is caused to open to the atmosphere. A suction pump 14, which is a reduced pressure generating source for making the pressure inside the buffer a negative pressure, and a waste liquid bottle 16 are connected to the lower part of the buffer 35 by a pipe. Further, a one-way valve 37 is connected to each of the suction side and the exhaustion side of the pump 14. Accordingly, the ink in the buffer 35 is sucked by the suction pump 14, and is accumulated in the waste liquid bottle 16.

Next, the operation of the maintenance mechanism configured in the manner described above will be described below with reference to FIGS. 9 to 11.

As described previously, FIG. 4 shows a state where the recording head group 17 accesses the conveying system so as to form an image on the recording medium 2, and shows that the maintenance unit 8 is located at a position at which the unit 8 is retracted from below the recording head group 17 to the downstream side in the conveying direction of the recording medium 2. In the image forming state, the belt 706 of the belt conveying unit 7 is opposed to the nozzle surface 100 in close proximity to the surface 100. The maintenance unit 8 is stored from the guide rails 23 and 24 at a position on the downstream side of the recording head group 17 in the conveying direction of the recording medium 2 in a state where the pins 8*b* and 8*c* collide with the ends 23*c* and 24*c* of the grooves 23*f* and 24*f*, and the unit 8 is bent around the hinged fulcrums 8*g* and 8*h* against the biasing force so as to form a V-shape (see FIG. 5). In this stored state, the maintenance unit 8 is bent at a position between the cap 31 for the recording head 17-1C (cyan) and the cap 31 for the recording head 17-1M, the cap 31 for the recording head 17-1C and the cap 31 for the recording head 17-1M (magenta) corresponding to the recording head 17-1C and the recording head 17-1M which are the recording heads for the two adjacent colors, respectively. Accordingly, although the maintenance unit 8 is in the bent state, all the caps 31 are kept in a state where the caps 31 are free from a load caused by the other members or contact with the other members, and are fixed to the bottoms of the ink pans 801 and 802.

The belt conveying unit 7 is moved in the vertical direction between a first position (FIG. 4), at which a gap of about 1 mm is held between the belt 706 and the nozzle surfaces 100 of the recording head group, and a second position (FIG. 10), largely lower than the first position, by a hoisting and lowering mechanism (not shown).

When the maintenance processing is to be performed, first, as shown in FIGS. 4 to 11, the belt conveying unit 7 is lowered from the first position to the second position. Then, the motor 804 provided in the head maintenance unit 8 rotates in the forward direction, and the gear 803 engaged with the rack 23*d* is rotated, whereby the maintenance unit 8 is moved to the upstream side in the conveying direction of the recording medium 2, while being supported by the guide rails 23 and 24.

Figure 11:
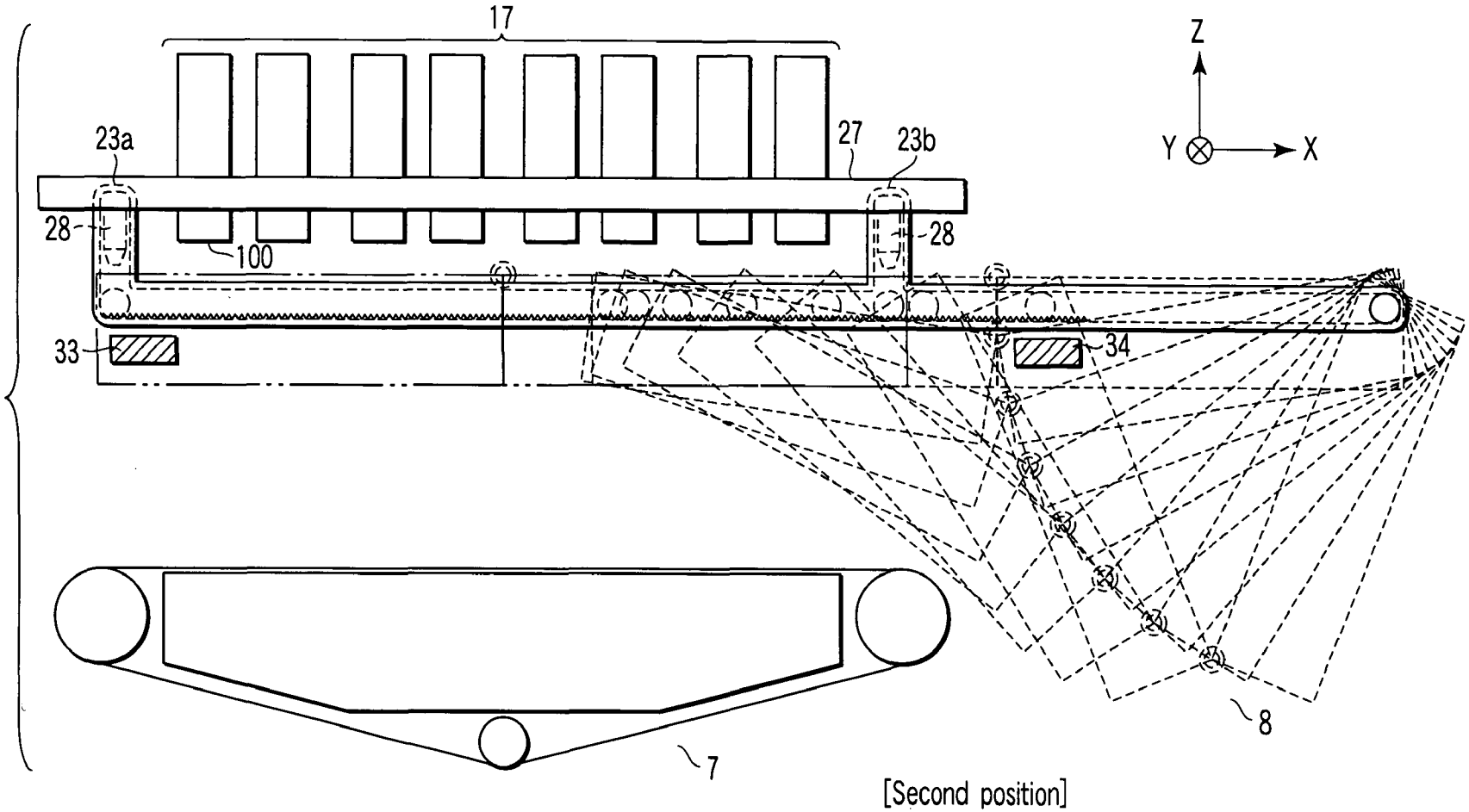
FIG. 11 is a view for explaining a "folding locus" of the operation of the maintenance mechanism.

At this time, as shown by the loci in FIG. 11, simultaneously the ink pans 801 and 802 are rotated to be opened with the hinged fulcrums 8*g* and 8*h* being the center by the biasing force of the spring. The second position of the belt conveying unit 7 is set in such a manner that the loci of these ink pans 801 and 802 do not interfere with the belt conveying unit 7. Thereafter, the ink pans 801 and 802 are expanded into the 180° posture, and their upper surfaces become flat.

Figure 10:
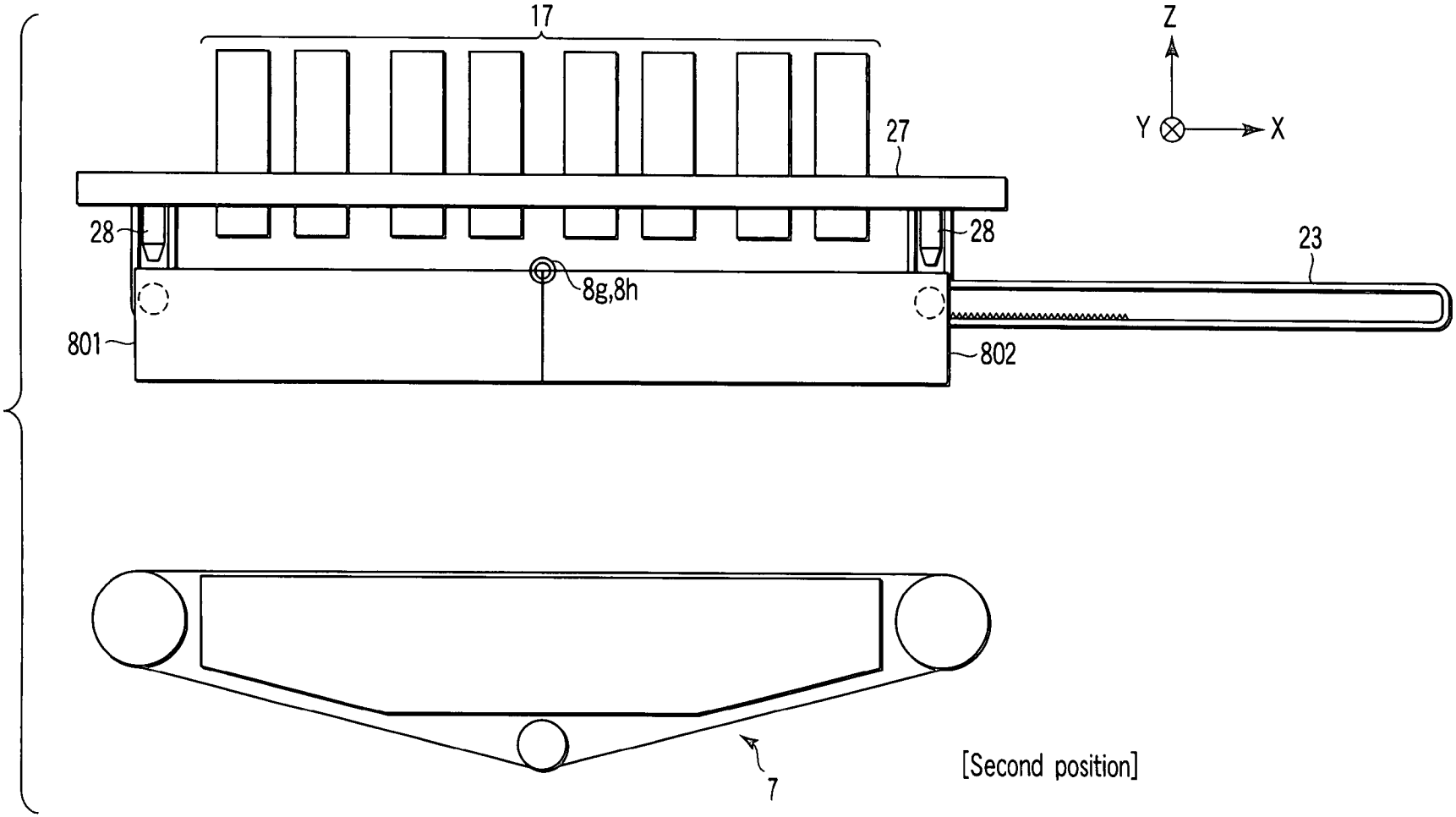
FIG. 10 is a view for explaining a "second position" of the operation of the maintenance mechanism.

As shown in FIG. 10, these ink pans 801 and 802 are further moved horizontally below the recording head group 17, and the ink pan 801 is detected by a sensor 33 (shown in FIG. 11) at a position at which the gear 803 collides with the end of the rack 23*d*, and is stopped there.

Figure 12:
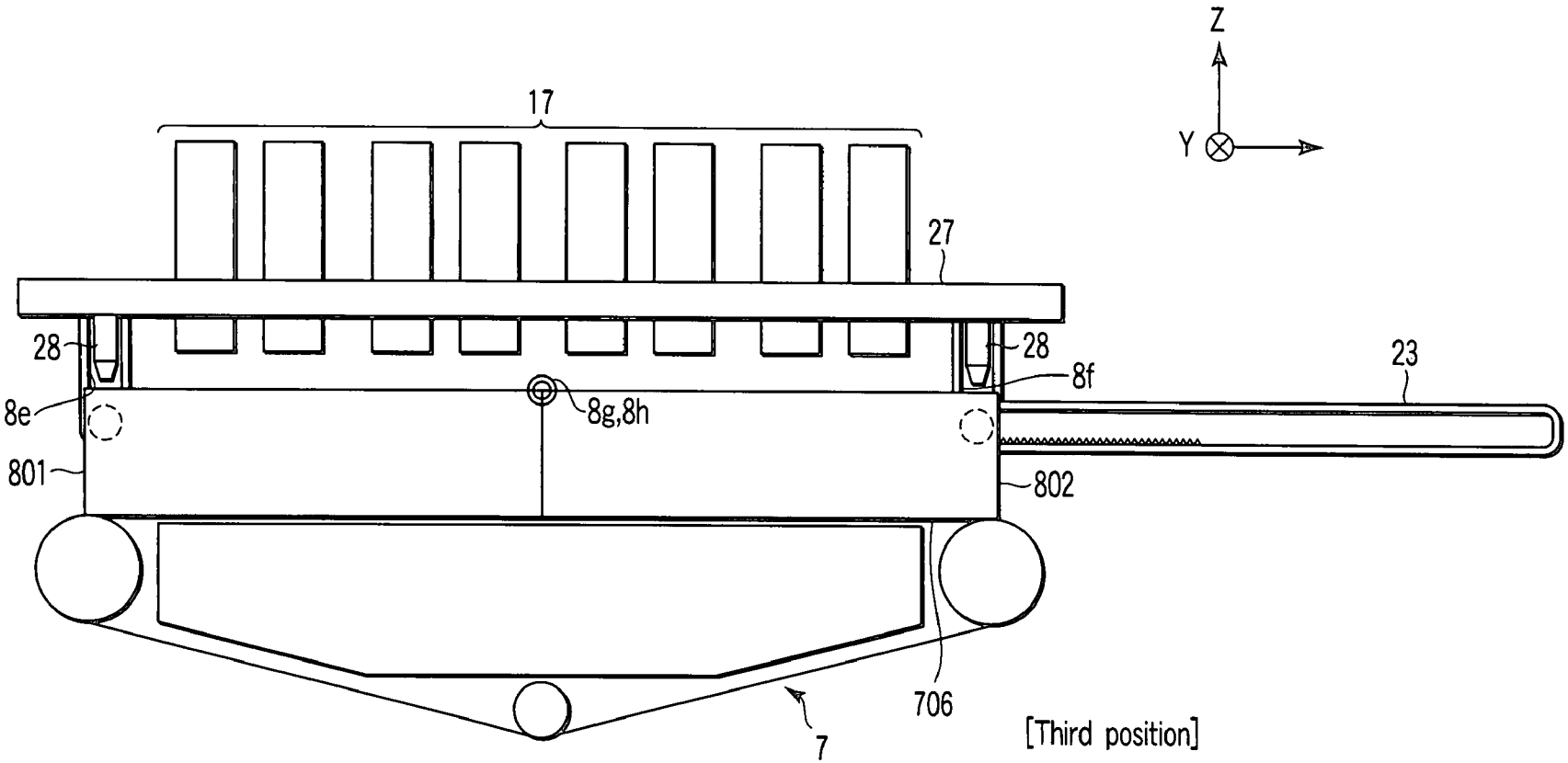
FIG. 12 is a view for explaining a "third position" of the operation of the maintenance mechanism.

Then, the belt conveying unit 7 is elevated and then, as shown in FIG. 12, is brought into contact with the ink pans 801 and 802 in such a manner that the belt 706 supports the bottoms of the ink pans 801 and 802 from below. This position at which the belt 706 is in contact with the bottoms of the ink pans 801 and 802 is made the third position of the belt conveying unit 7, in the height direction. Accordingly, even when the ink pans 801 and 802 are in a state where the hinged fulcrums 8*g* and 8*h* are somewhat lowered by their own weight, when the belt 706 is elevated to the third position, the belt conveying unit 7 lifts up the bottoms of the ink pans 801 and 802 so as to open them up until they are completely flat.

Figure 9:
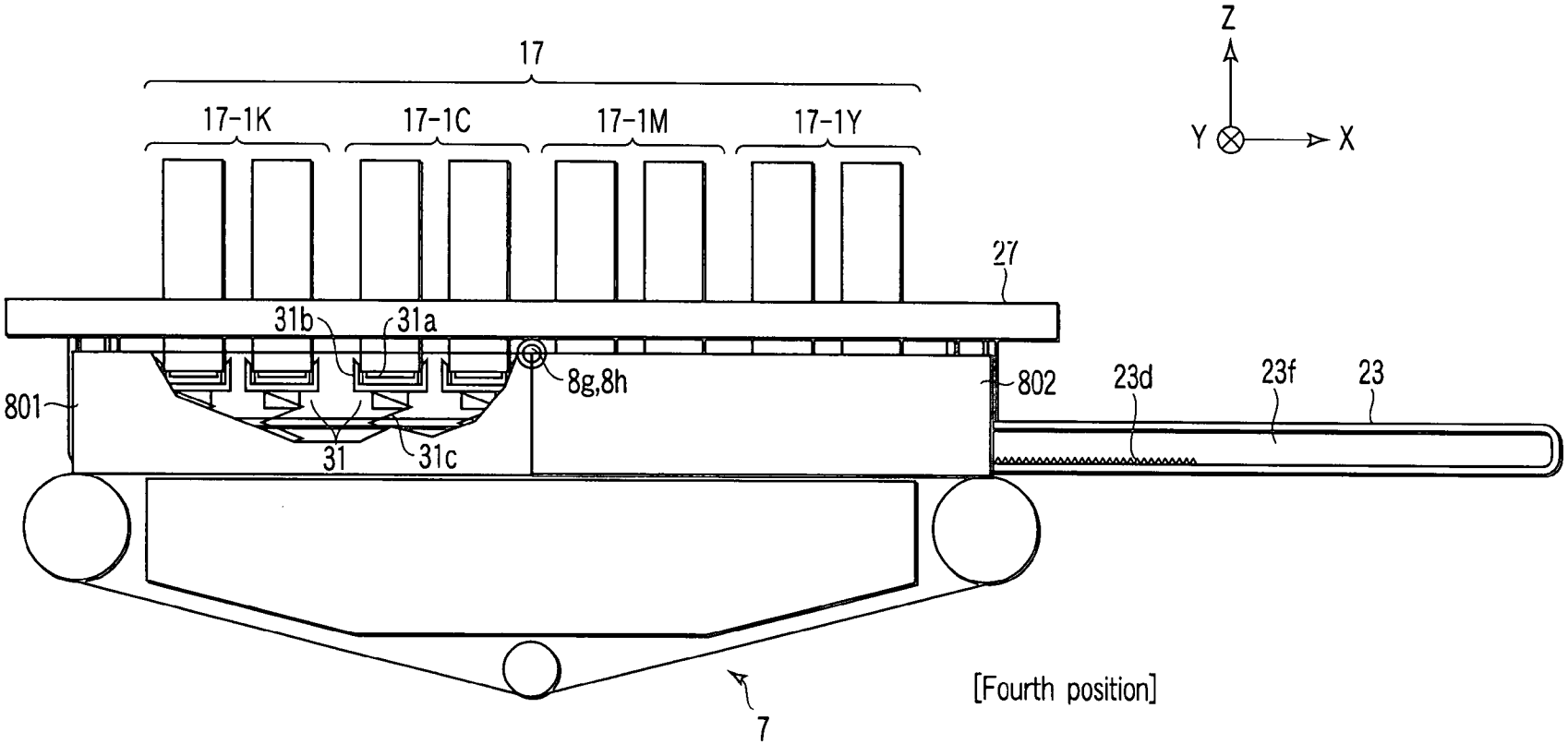
FIG. 9 is a view for explaining a "fourth position" of the operation of the maintenance mechanism.

Then, as shown in FIG. 9, the belt conveying unit 7 is further elevated, and when it is elevated up to the fourth position, the plural caps 31 inside the ink pans 801 and 802 are respectively brought into contact with the nozzle surfaces 100 of the recording head modules 17*a* to 17*f*, and seal the nozzle surfaces 100. At this time, positioning pins 28 (see FIGS. 10 and 11) a provided at two positions on the head mount 27 are fitted in positioning holes 8*e* and 8*f* provided on the ink pans 801 and 802, thereby completing positioning of the maintenance unit 8 with respect to the head mount.

Further, as for the recording head modules 17*a* to 17*f*, the guide 31*b* provided on each cap 31 is first position-guided by the external shape of each of the recording head modules 17*a* to 17*f*, and finally the rubber piece 31*a* is brought into contact with the nozzle surface 100 of each of the recording head modules 17*a* to 17*f*. Accordingly, it is possible to cover the nozzle surface 100 with the rubber piece 31*a* in such a manner that the rubber piece 31*a* is not brought into contact with the nozzle that ejects ink. At this fourth position, each cap 31 is pressed against each of the recording head modules 17*a* to 17*f* so as to be positioned by the elastic force of the spring 31*c*, and hence there is no fear of an unnecessarily excessive hoisting or lowering force of the belt conveying unit 7 adversely affecting the recording head 17.

In this state, the suction pump 14 is operated so as to reduce the pressure inside the buffer 35 and obtain a negative pressure of −15 kPa with respect to the atmosphere and, thereafter the valve 38 is opened so as to make the pressure throughout the entire sealed space up to the nozzle surfaces covered with all the rubber pieces 31*a* of the caps 31 negative through the coupling member 32. Due to the negative pressure, the ink inside the recording head modules 17*a* to 17*f* can be sucked from the nozzle holes 101 to the outside. By virtue of this sucking operation, foreign substances clogging the nozzle holes, thickened ink, and the like are sucked to the cap 31 side on the ink stream, thereby keeping the recording head modules 17*a* to 17*f* in the state where ink can be normally ejected. The sucked ink is partly guided into the coupling member 32. By opening the valve 36, the negative pressure inside the buffer 35 returns to atmospheric pressure, and the suction from the recording heads 17 is completed. Thereafter, the belt conveying unit 7 is lowered to the third position shown in FIG. 12. In this state, the height difference between the cap 31 and the nozzle surface 100 of the recording head 17 is about 5 mm. Thereafter, the belt conveying unit 7 is further lowered to the second position shown in FIG. 11.

Then, the motor 804 is rotated in the reverse direction, whereby the head maintenance unit 8 is retracted to the downstream side in the conveying direction of the recording medium 2, the pins 8*b* and 8*c* collide with the ends 23*c* and

24*c* following the movement loci shown in FIG. 11 in a reversed way, and then the head maintenance unit 8 is folded into a V-shape. More specifically, when the motor 804 is rotated in the reverse direction, the gear 803 engaged with the rack 23 is rotated in the reverse direction, the ink pans 801 and 802 are moved to the downstream side in the conveying direction of the recording medium 2 along the guide rails 23 and 24 in a state where the ink pans 801 and 802 are flush with each other. The ink pans 801 and 802 are moved, and even when the pins 8*b* and 8*c* of the ink pans 802 collide with the ends 24*c* and 23*c* of the guide rails 24 and 23, the gear 803 continues to be rotated in the reverse direction. As a result, the ink pans 801 and 802 are turned and bent around the hinged fulcrums 8*g* and 8*h*, which are the coupling sections for coupling the ink pans 801 and 802, towards each other so as to form a V-shape. In the process in which the maintenance unit 8 changes from the flat state to the V-shaped state, the ink pan 801 is turned in a state where the bottom surface of the ink pan 801 is kept opposed to the belt conveying unit 7 as shown in FIG. 11. At this time, the rear end of the ink pan 801 in the conveying direction of the recording medium is moved in the horizontal direction since the pins 8*a* and 8*d* are supported by the guide rails extending in the horizontal direction. In contrast, the front end of the ink pan 802 in the conveying direction of the recording medium is gradually moved to the downstream side in the conveying direction of the recording medium and downwardly along the movement loci of the hinged fulcrums 8*g* and 8*h*. The movement loci of the hinged fulcrums 8*g* and 8*h* are formed on a circular arc drawn when a line segment defined by the length of the ink pan 802 in the conveying direction of the recording medium is rotated around the ends 23*c* and 24*c* of the guide rails 23 and 24. One end side (rear end in the conveying direction of the recording medium) of the ink pan 801 is moved along the circular arc, and the other end side (front end in the conveying direction of the recording medium) of the ink pan 801 is moved along the circular arc in the manner described above, whereby an effect of reducing the space necessary for the movement of the ink pan 801 is obtained.

Thereafter, when the belt conveying unit 7 is elevated from the second position to the first position, the state in which image formation can be performed is realized.

When the belt conveying unit 7 is present at the first position, the positioning pins provided on the head mount 27 are fitted in positioning holes (not shown) provided on the belt conveying unit 7, thereby positioning the head mount on the belt conveying unit 7. At this time, positioning is performed such that the gap between the nozzle surfaces 100 and the endless belt 706 is about 1 mm owing to the excellent degree of parallelization of all the head modules.

As a characteristic of this embodiment, the head maintenance unit 8 is stored so as to be stored from the guide rails 23 and 24 beneath the paper ejection guide 39. Further, the head maintenance unit 8 is retracted to a position on the paper ejection side of the ascent/descent space of the belt conveying unit 7. The head maintenance unit 8 is retracted to this storage position, whereby it is possible even if by any chance seepage of ink from the head maintenance unit 8 occurs, to prevent the ink from adhering to the members constituting the conveying mechanism and the recording medium.

Next, image formation will be described below with reference to FIGS. 1, 2, and 3. The recording media 2 on the paper feed tray 1 are conveyed by the paper feed roller 3, lined up by the resist roller pair 5, and are conveyed onto the belt conveying unit 7. The recording medium 2 is brought into close contact with the belt conveying surface by the pinch roller 6, and is further conveyed while being held against the endless belt 706 through the holes of the platen 704 by the negative pressure of the suction fans 705 incorporated in the belt conveying unit 7. While the recording medium 2 is passing a part beneath the recording head modules 17, ink ejected from the nozzles holes 101 hits the recording medium 2, thereby forming an image.

The recording head group 17 is arranged in the order of black, cyan, magenta, and yellow in the recording medium conveying direction, and the recording medium 2 once passes a part above the belt conveying unit 7, whereby a color image of four colors is recorded thereon. As for the size of the recording medium 2, it is possible to make the apparatus compatible with various sizes by increasing the width of the platen and the length of the nozzle array. It is easily possible to make the apparatus compatible with the general postal card size to the A3 size. Needless to say, it is also possible to make the apparatus compatible with a roll sheet by changing the conveying mechanism. As shown in FIG. 4, the maintenance unit 8 of this embodiment is folded such that an angle formed by the V-shape becomes 40°, and is stored at a part beneath the paper ejection guide 39. By storing the maintenance unit 8 in the manner described above, a contrivance is made such that the ink ejected or sucked from the nozzle holes 101 of the recording head module 17 is collected in the caps 31 and falls from the inside of each of the caps 31 to the outside, due to the 70° inclination of the ink pans 801 and 802.

Figure 13A:
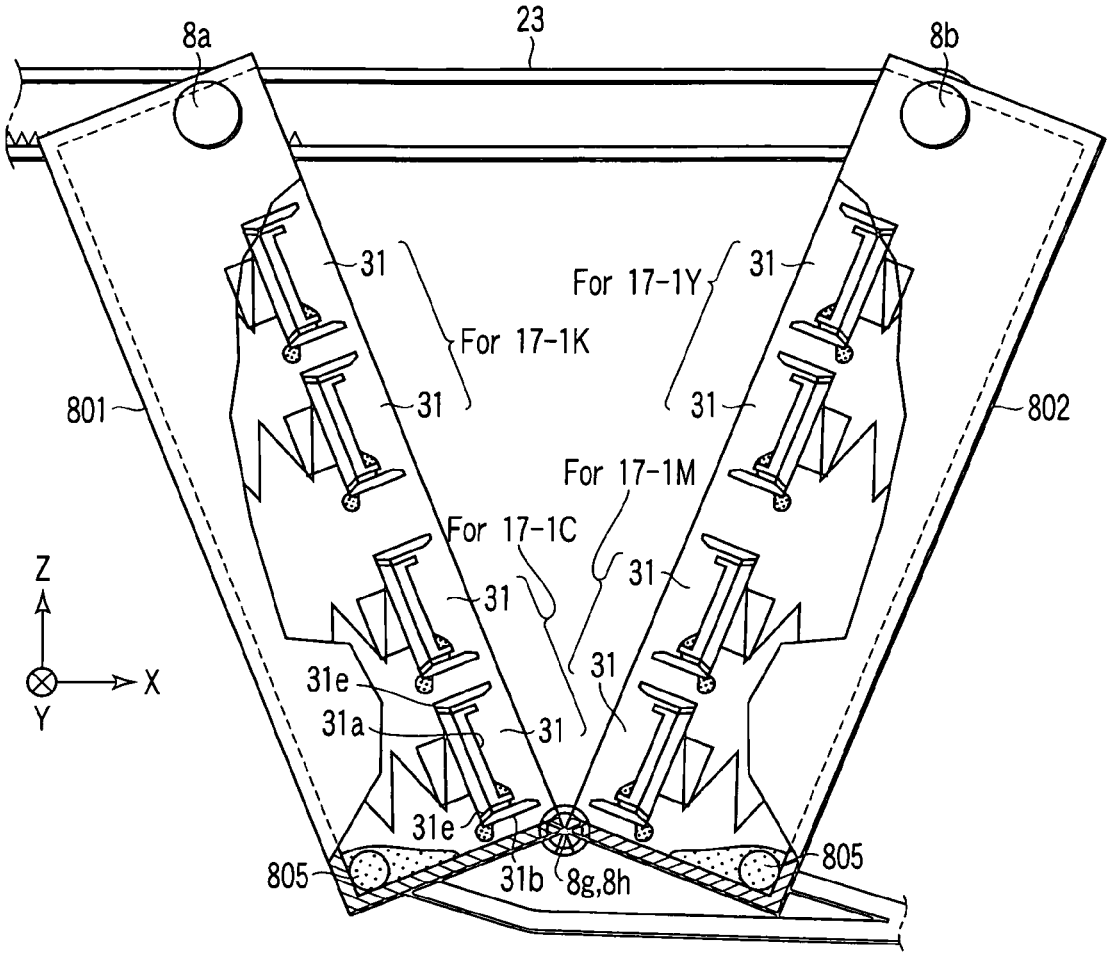
FIG. 13A is a view showing the retracted state of the maintenance unit.
Figure 13B:
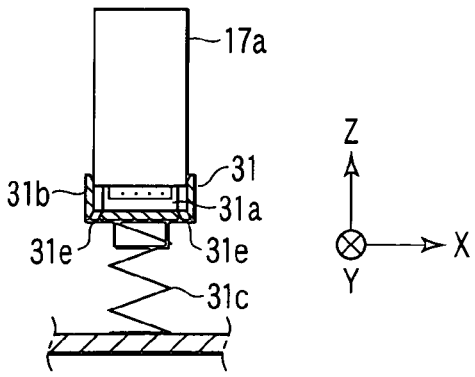
FIG. 13B is a view showing the state where ink is sucked from the recording head module.

FIG. 13B shows a maintenance operation of sucking ink from the recording head module 17*a* or the like. As shown in FIG. 13B, the cap 31 is caused to closely approach the nozzle surface 100 of the recording head module 17*a* or the like, and ink is sucked by the suction pump 14 through the suction hole 31*d*. The inside of the rubber piece 31*a* of the cap 31 is brought into a state where it is filled with ink, and thereafter the cap 31 is separated from the nozzle surface 100. After the cap 31 is separated from the nozzle surface 100, the maintenance unit 8 moves from the part beneath the recording head group 17, and assumes a V-shape at the retraction position as shown in FIG. 13A.

In order to discharge ink from a gap between the rubber piece 31*a* and the guide 31*b* to the outside, a plurality of drains 31*e* are opened in the bottom of the guide 31*b* of the cap 31 on both sides in the X-direction. Even when the caps 31 arranged in the ink pans 801 and 802 are inclined to either side, ink drains out of each of the caps downwardly through any one of the drains 31*e*. When the ink pans 801 and 802 are inclined in a V-shape, almost all the ink collected in each of the rubber pieces 31*a* flows down into each of the guides 31*b*, and then drops into each of the ink pans 801 and 802 through the drains 31*e*. Inside the ink pans 801 and 802, the ink collects at the lowermost corner, and is then discharged from the ink exhaust port 805 to the waste liquid bottle 16 through a tube.

By virtue of the configuration described above, the ink does not drip down to the outside from the ink pans 801 and 802, which would make the inside of the apparatus dirty. Further, when the cap 31 comes into contact with the nozzle surface 100 next time to seal the nozzle surface again, ink collected in the cap 31 does not contact the nozzle surface 100 again, which would otherwise stain the nozzle surface due to the thickened ink or dust particles contained therein, or clog the nozzle. The caps 31 are arranged in the ink pans 801 and 802 so as to be opposed to each other, and the paper ejection guide 39 extends above the head maintenance unit so as to cover the whole head maintenance unit, and hence paper dust generated from the recording medium 2 is prevented from accumulating on the caps 31. Further, the drains 31*e* are arranged at lower positions in the direction of gravitational force, and hence ink is prevented from dropping into another cap 31 of another color, which prevents colors being mixed on the cap 31, or, by extension, on the nozzle surface 100.

As a characteristic of this embodiment, the head maintenance unit 8 is stored so as to be stored from the guide rails 23 and 24 beneath the paper ejection guide 39, and is retracted to a position on the paper ejection side of the ascent/descent space of the belt conveying unit 7. The head maintenance unit 8 is retracted to this storage position, whereby it is possible even if by any chance seepage of ink from the head maintenance unit 8 occurs, to prevent the ink from adhering to the members constituting the conveying mechanism and the recording medium.

FIG. 6A is a view showing the configuration of the recording head group 17 and the maintenance unit 8 viewed from the paper ejection roller pair 25 side.

FIG. 6A shows a configuration example in which the guide rails 23 and 24 are arranged in parallel with each other on the same level. In this configuration, ink collected in the cap 31 flows down, and the ink collected in the ink pan flows down from the ink exhaust port 805.

Further, FIG. 7 shows a configuration example in which the groove section of the guide rail 23 is arranged lower than the groove section of the guide rail 24. In this arrangement, the ink pans 801 and 802 of the head maintenance unit are held in a state where the guide rail 23 side is kept lower than the guide rail 24 side. Accordingly, in the case where one side of the head maintenance unit is held lower so as to be arranged aslant, ink can flow down from the cap more easily, and does not collect in the ink pans 801 and 802, which is more desirable, as compared with the configuration example shown in FIG. 6A in which the guide rails 23 and 24 are arranged in parallel with each other on the same level.

According to this embodiment, although the maintenance unit 8 is stored at the retraction position in the bent state, none of the caps are bent or subjected to deformation. Accordingly, the caps are not deformed, deterioration such as cracking at the bent corner of the cap hardly occurs, and the degree of tightness of the sealing of the ejection surface of the recording head is not lowered. Further, the ink pans 801 and 802 are coupled to each other by the hard pins, and no members having flexibility are used, and hence the ink pans are excellent in durability, and malfunctioning caused by deterioration of elastic members (or flexible members) as in the prior art does not occur.

Further, the retraction position of the maintenance unit 8 is lower than the conveyance path of the recording medium 2, and hence even if a state where ink remaining in the maintenance unit 8 leaks out occurs by any chance, no case occurs where the ink adheres to the recording medium 2 to stain it. Furthermore, since the retraction position is lower than the members of the conveying mechanism, ink does not adhere to the members as in the above case, and indirect staining of the recording medium 2 can be prevented from occurring. Moreover, the maintenance unit 8 is folded into a V-shape so as to be retracted to a position beneath the paper ejection guide 39 necessary for ejecting a recording medium 2 on which an image has been formed, and the retraction space for the maintenance unit 8 is therefore small and the apparatus can be downsized.

Next, a second embodiment will be described below.

This embodiment is of a configuration example in which a pressure pump is provided in place of the suction pump in the first embodiment. Incidentally, constituent members of this embodiment equivalent to those of the first embodiment are denoted by the same reference symbols as those of the first embodiment, and description of them will be omitted.

Figure 14:
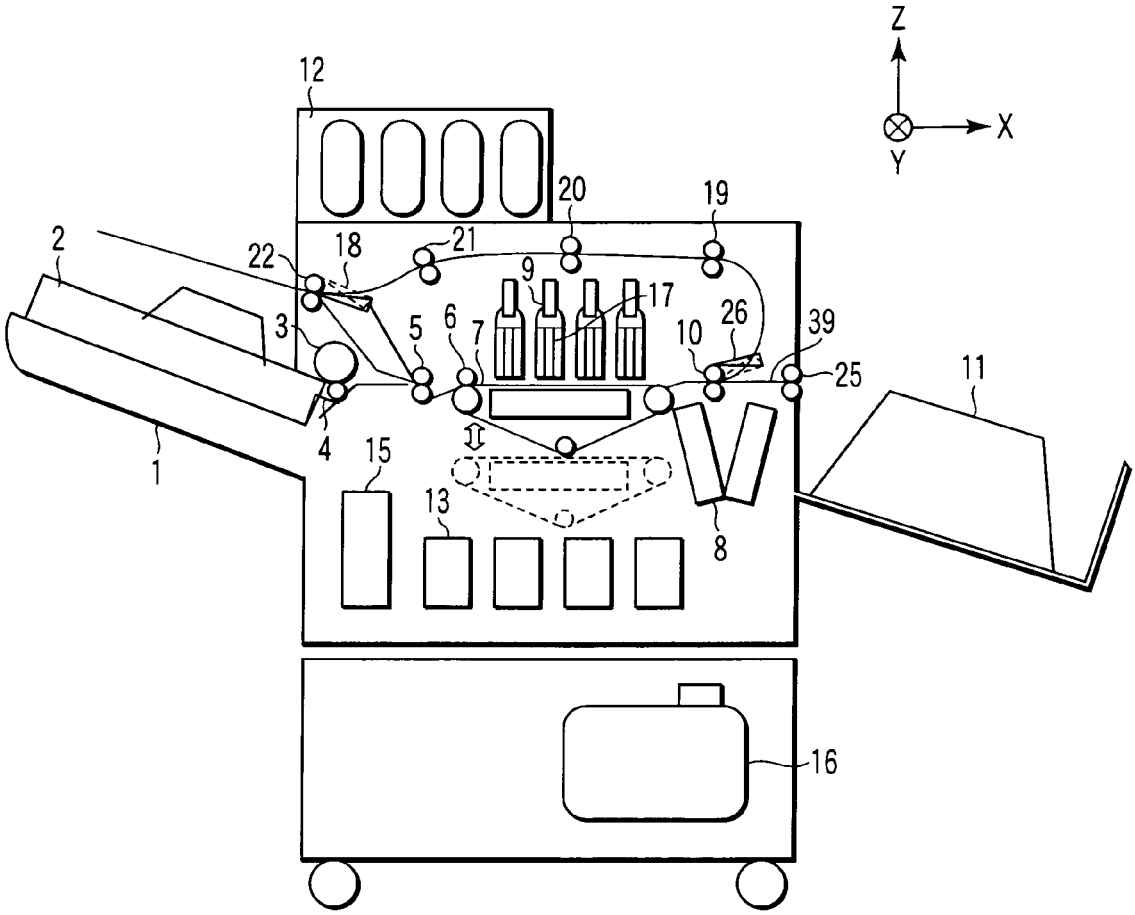
FIG. 14 is a view showing a conceptual configuration of the entire image forming apparatus according to a second embodiment.

In FIG. 14, a pressure pump 15 for pressurizing the sub-tank unit 13 side arranged on the upstream side of recording head modules 17*a* to 17*f* is provided. The pressure pump is, for example, a piston pump, and is connected to the sub-tank unit 13 by means of a tube. The sub-tank unit 13 is charged with ink with which the recording head modules 17*a* to 17*f* are replenished, and an air space is provided in the upper part thereof.

Figure 15:
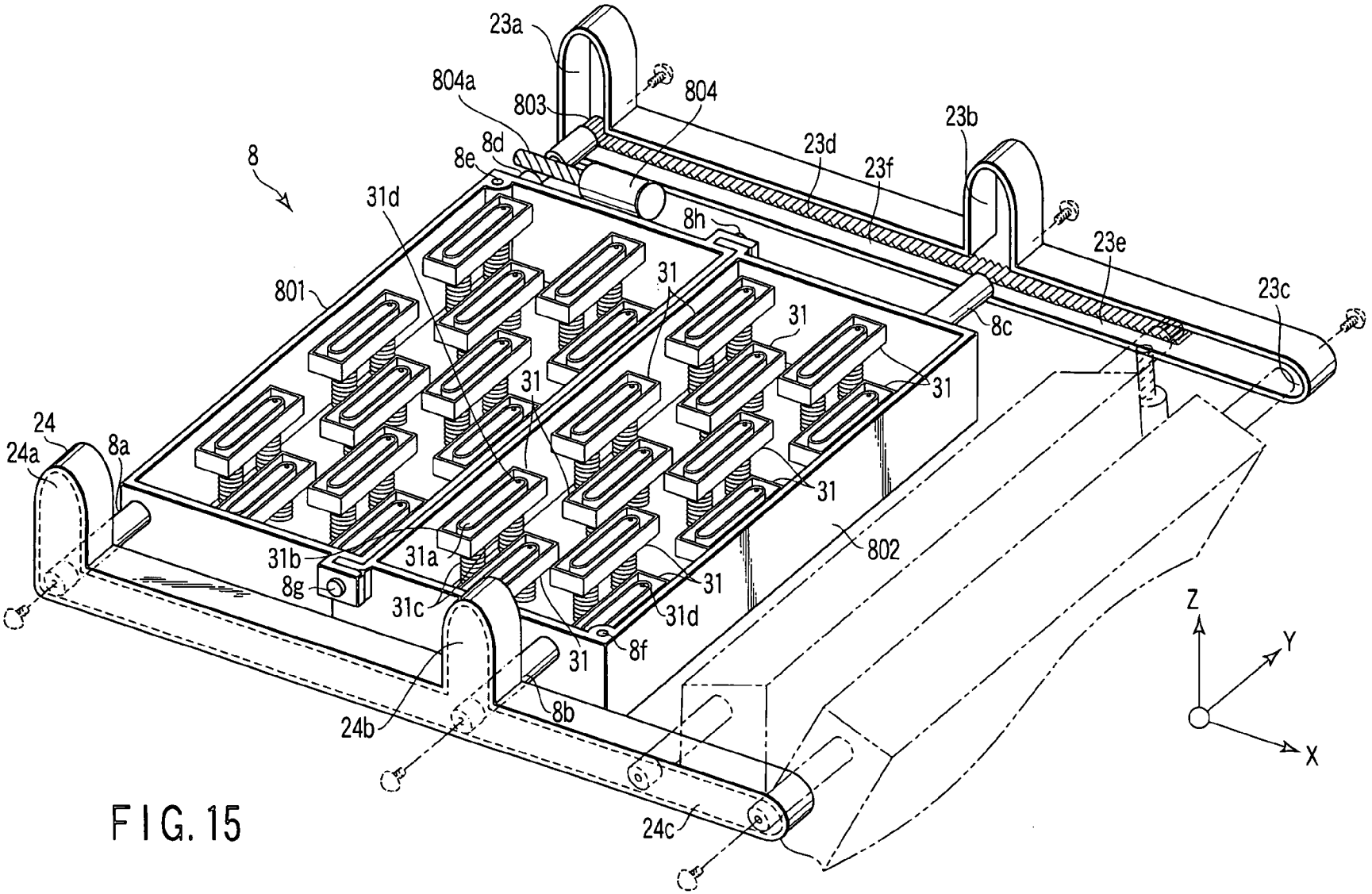
FIG. 15 is a view showing a configuration example of a head maintenance unit according to the second embodiment.
Figure 16A:
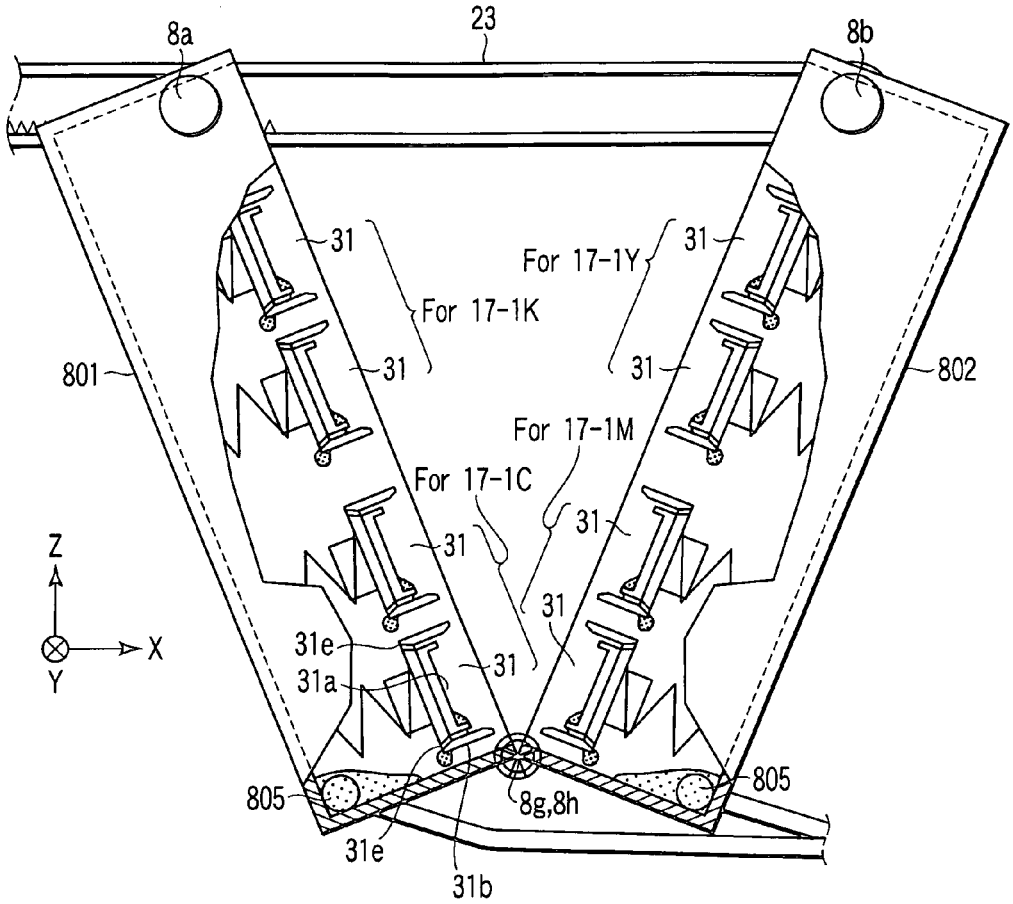
FIG. 16A is a view showing the retracted state of the maintenance unit.
Figure 16B:
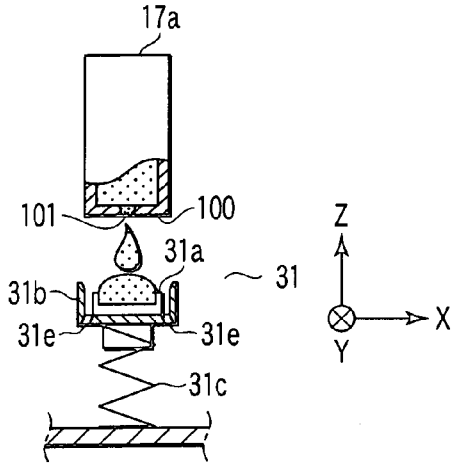
FIG. 16B is a view showing the state where ink drops from the recording head module into the cap.

As shown in FIG. 15, a suction hole 31*d* is not opened in a cap 31, and when the cap 31 is brought into contact with a nozzle surface 100, the inside of the cap 31 becomes a completely sealed space. The maintenance processing to be performed to restore ink ejection of the recording head modules 17*a* to 17*f* will be described below. First, a head maintenance unit 8 is moved to a position shown in FIG. 12 at which the caps 31 are separate from the nozzle surfaces 100, and are directly below a recording head group 17. Thereafter, the pressure pump 15 is driven so as to pressurize the inside of the sub-tank unit 13 in a state where the inside thereof is sealed. By this pressurization, the inside of the recording head modules 17*a* to 17*f* is pressurized through a tube 902, a common ink supply route 901, and a tube 903, and further, the ink inside the recording head modules 17*a* to 17*f* is extruded from the inside to the outside, and drops onto the caps 31. The caps 31 have no holes, and thus the ink collects inside the caps 31. When the amount of ink dropped is large, the ink overflows from the caps and flows down into ink pans 801 and 802 as shown in FIG. 16B.

The flow of ink down into the ink pans 801 and 802 will be described below with reference to FIG. 16A.

A plurality of drains 31*e* are opened in a guide 31*b* of the cap 31 so as to exhaust ink from the gap between a rubber piece 31*a* and the guide 31*b* to the outside. The caps arranged in both the ink pans 801 and 802 are the same as each other in design, and when they are inclined to either side, the ink inside the caps flows out downwardly through any one of the drains. The ink dropping from the recording head modules 17*a* to 17*f* first collects inside the rubber pieces 31*a*, and when the ink overflows from the rubber pieces 31*a*, the ink flows into the guides 31*b*, and the ink inside the guides 31*b* flows out through the drains 31*e* into the ink pans 801 and 802.

Further, when the head maintenance unit 8 is moved to the retraction position so as to be folded into a V-shape, almost all the ink collected inside the rubber pieces 31*a* flows down into each of the guides 31*b*, and then drops into each of the ink pans 801 and 802 through the drains 31*e*. Inside the ink pans 801 and 802, the ink collects at the lowermost corner, and is then guided from the ink exhaust port 805 to the waste liquid bottle 16 through a tube. As shown FIGS. 16A, 16B, 6A, 6B, and 7, the caps 31 are arranged in a staggered form in accordance with the arrangement of the recording head modules 17*a* to 17*f*, and are arranged in such a manner that the distance between each of the recording head modules 17*a* to 17*f* of different colors is larger than the interval between each of those of an alternate arrangement of a single color. As for the alternate arrangement of FIG. 16A, for example, of the arrangement of four caps in the ink pan 801, the recording head modules of the set of the uppermost one and the third one from above, or the set of the second one from above and the lowermost one correspond to the alternate arrangement of FIG. 16A. When the ink pans 801 and 802 are located at the retraction position, a cap 31 of another color is not present directly beneath the drain 31*e*. Thus, the dropping ink neither causes color mixture in cooperation with ink of the cap 31 for the other color nor stains the nozzle surfaces 100 of the recording head modules 17*a* to 17*f*. The depth of the rubber piece 31*a* of the cap 31 of this embodiment is about 1.2 mm.

As for the cap size, the width is 10 mm, and the length in the longitudinal direction is about 60 mm. Needless to say, the size is not limited to these values. Accordingly, in the state where the ink pans 801 and 802 are inclined in a V-shape, almost all the ink inside the rubber piece 31*a* flows down from the inside of the cap 31. Although a slight amount of ink remains on the periphery of the rubber piece 31*a* surface, when the cap 31 seals each of the recording head modules 17*a* to 17*f* again, the cap 31 is in a horizontal posture, and hence the remaining ink spreads thin and does not come into contact with the nozzle surface 100.

When the maintenance processing is performed, the ink pans 801 and 802 become horizontal. Thereafter, the pressure of the pressure pump 15 is released by the opening of a valve (not shown), and a wiper (not shown) wipes the nozzle surface 100 so as to remove excess ink. The ink flowing down along the wiper also flows down into the cap 31 or the ink pan 801 or 802. By this series of processes, cleaning of the nozzle surfaces 100 of the recording head modules 17*a* to 17*f*, and removal of the thickened ink inside the nozzle holes are completed.

Then, the head maintenance unit 8 is moved to the retraction position at which the head maintenance unit 8 is folded into a V-shape. After the head maintenance unit 8 is retracted, if image formation is to be performed subsequently, the belt conveying unit 7 is elevated to the first position, and if image formation is not performed, the belt conveying unit 7 is kept at the second position as it is.

When retracted, the head maintenance unit 8 is bent into a V-shape, whereby the ink inside the cap 31 drops. Further, the ink inside the ink pans 801 and 802 collects at the lower part, and flows out through the ink exhaust port 805 toward the waste liquid bottle 16. In the manner described above, it becomes possible, even when a suction hole is not provided in the cap 31, to exhaust the ink inside the cap 31 to the outside. By virtue of the operation of collecting ink in the cap 31, and causing it to flow out, dust particles entering the cap 31 can also be washed away.

Then, when the head maintenance unit 8 moves to seal the recording head modules 17*a* to 17*f* again, and seals the nozzle surface 100 as shown in FIG. 9, ink is not accumulated in the cap 31, and hence thickened ink does not adhere to the nozzle surface 100. Further, any dirt inside the cap 31 has already been washed away with ink having low viscosity, and hence it is possible to reduce the possibility of any dust particles clogging the nozzle hole 101. Furthermore, the cap is not provided with a hole, the nozzle surface 100 is completely sealed, and the inside of the cap 31 is properly wetted with ink, whereby an effect of filling the inside of the cap 31 with a vaporized component of ink, and better preventing the nozzle surface 100 of each of the recording modules 17*a* to 17*f* from drying can be obtained.

Next, a third embodiment will be described below.

This modification example is a configuration example which can be applied to the above-mentioned first and second embodiments, and in which the ink inside the recording head modules 17*a* to 17*f* is circulated.

Figure 17:
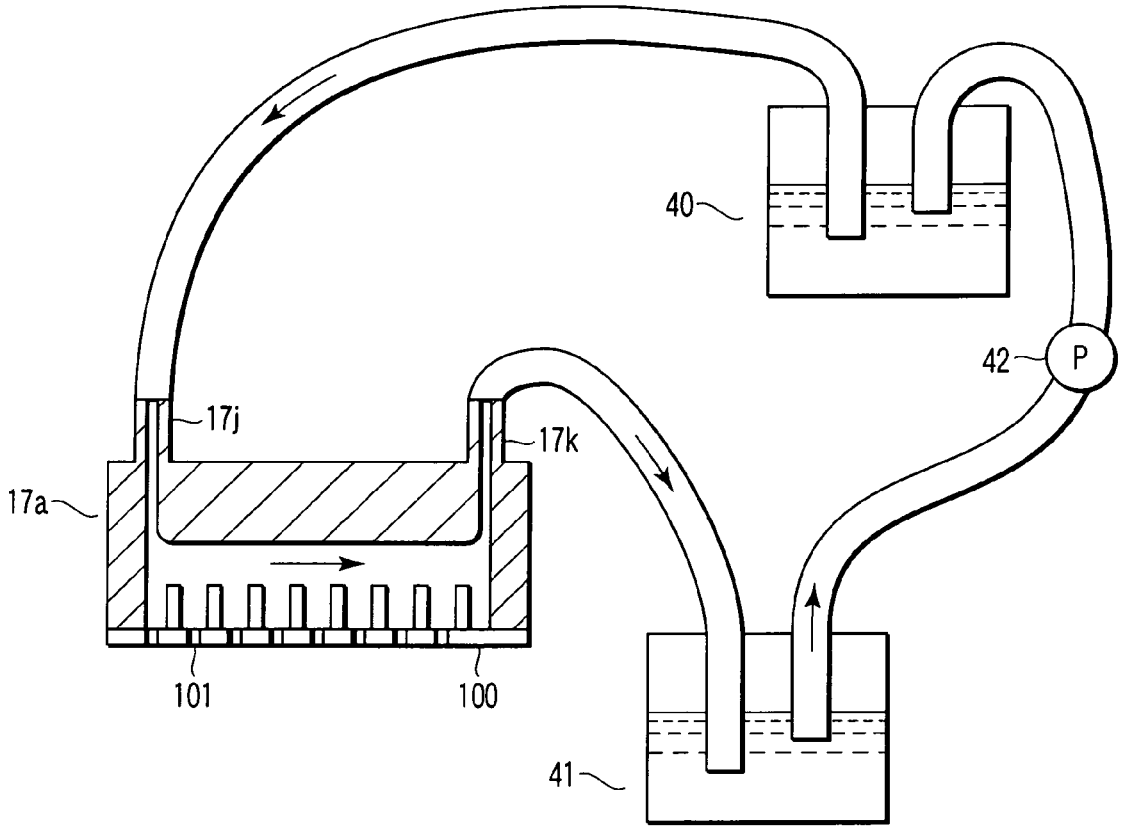
FIG. 17 is a view showing a configuration example of an ink circulation mechanism.

As shown in FIG. 17, each of the recording head modules 17*a* and the like is provided with an inlet 17*j*, through which ink is poured, and an outlet 17*k*, from which ink is discharged to the outside (in this case, a sub-tank 41). The inlet 17*j* is connected to a sub-tank 40 having an ink level at a higher position than the nozzle surface 100 by a tube, and the outlet 17*k* is connected to the sub-tank 41 having an ink level at a lower position than the nozzle surface 100. The sub-tank 41 and the sub-tank 40 are connected to each other by a tube through an ink circulating section (pump) 42 for moving ink from a lower position to a higher position. The ink flows from the sub-tank 40 to the sub-tank 41 through each internal ejection channel section such as the recording head module 17*a* and the like, and is then returned to the sub-tank 40 again by the ink circulating section 42.

In a configuration in which drains are not opened in the cap 31, there is a fear that when the nozzle surface 100 is sealed by the cap 31, the pressure inside the cap becomes slightly positive due to the deformation of the rubber piece 31*a* so as to thrust retained air into the recording head. In such a case, by driving the ink circulating section 42 so as to cause the ink to flow and circulate through the inside of the recording head modules 17*a* and the like, the air that has entered the inside is removed as air bubbles together with the ink flow, and rises in the sub-tank 41 or the sub-tank 40.

Further, when the state where the nozzle surface is capped is continued for a long period of time, air inside the cap is expanded or contracted by the temperature change in the ambient environment, and hence there is a fear that air intrudes into the recording head modules 17*a* and the like, or ink is drawn out from the recording head modules 17*a* and the like so as to be caused to flow out into the cap 31. When the ink flows out as described above, the head maintenance unit 8 is retracted from the capping state so as to be moved to the retraction position, and is bent into a V-shape, whereby it is possible to exhaust the ink accumulated in the inside to the outside, as described in each of the embodiments.

As described above, when the cap is to be separated from the nozzle surface prior to the start of a recording operation, an operation of inclining the head maintenance unit 8 in a V-shape so as to cause the ink in the inside to flow out, and a circulating operation of causing the ink inside the recording head modules 17*a* and the like to circulate, thereby causing the air inside the recording head modules 17*a* and the like to move are performed. In this state, ink remaining on the nozzle surface 100 is removed by means of a wiper (not shown). The ink pans 801 and 802 are in the lower position, and thus even if ink scattered by the wiper drops, the ink does not stain the endless belt 706.

In the recording heads 17-1K and the like of this embodiment, although six recording head modules 17*a* to 17*f* each of which is shorter than the width of the recording medium are arranged in two rows (one ink color) alternately in the staggered form, the arrangement may be stepwise. Further, the constituent number may be one or more. It is sufficient if caps are arranged so as to be correspondent to the arrangement and the number of the recording head modules 17*a* and the like.

Figure 18:
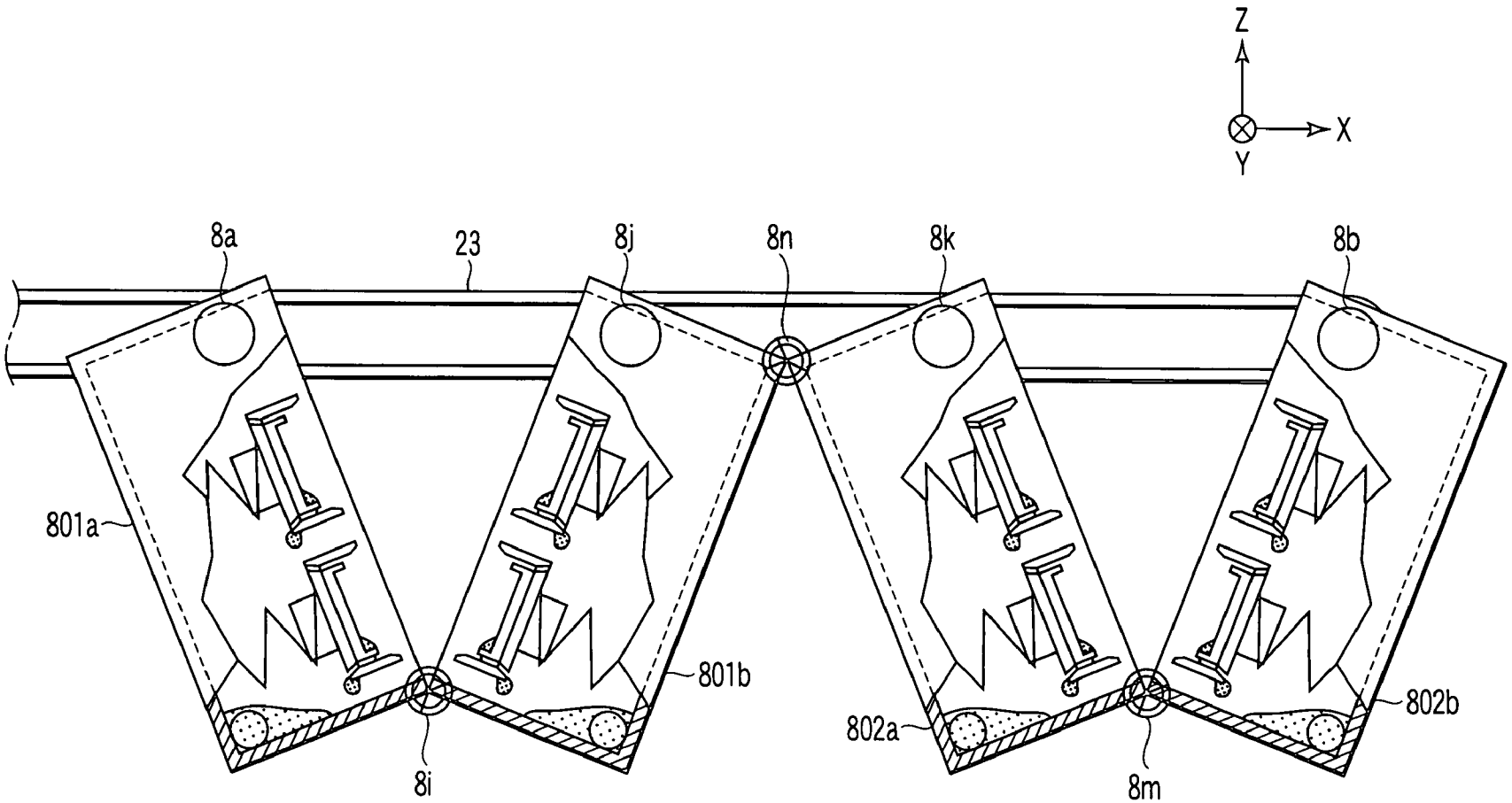
FIG. 18 is a view showing the retracted state of the maintenance unit where the ink pans are folded as four sections.

In the configuration of each of the embodiments described above, although the ink pans to which the caps 31 are fixed are folded as two sections, it is also possible to further divide the ink pans into a plurality of parts in accordance with the gaps of the recording head modules 17*a* and the like. For example, if the recording head 17-1 has an arrangement of four rows (four staggered rows), it is also possible to divide the arrangement at each gap so as to obtain the configuration as shown in FIG. 18 in which the arrangement is folded in four for each color. In this example, i.e., in the example in which recording heads of four colors are incorporated in the apparatus, caps 31 are fixed to four ink pans 801*e*, 801*b*, 802*a*, and 802*b* for each color (for one staggered row). These ink pans are connected to each other by pins 8*i* and 8*m* so as to obtain two V-shaped sets of ink pans in each of which caps are opposed to each other. Further, one ink pan of each of the two sets of V-shaped ink pans, i.e., the ink pan 801*b* and the ink pan 802*a*, are connected to each other by a pin 8*n*. Pins 8*a*, 8*j*, 8*k*, and 8*b* which are provided on the ink pans 801*a*, 801*b*, 802*a*, and 802*b* are fitted in a guide rail 23. As a result of the accordion-folding, which is comprised of zigzag bends, although the conveyance path length becomes large, the size in the height direction can be made smaller as compared with the image forming apparatus of each of the first and second embodiments. This can be suitably employed depending on the design specifications of the image forming apparatus. Further, the configuration is one in which the ink pans are folded for each ink, and hence ink of another color can be prevented from adhering to the cap. Moreover, since mixing of colors does not occur in each of the ink pans, it is possible to prevent a problem that inks different from each other in physical properties are mixed with each other and then harden or the like from occurring.

Functions and advantages of the image forming apparatus equipped with the maintenance mechanism according to each of the above-mentioned embodiments will be described below.

(1) At the retraction time, the head maintenance unit is bent to be moved to the retraction position, whereby it is possible to store the head maintenance unit in a space-saving manner, and reduce the installation area of the apparatus.

(2) The head maintenance unit includes the ink pans, and stops to form such an angle that ink does not drop out, whereby it is possible, at the storing time, to obtain space saving, and prevent ink from dropping to the inside of the apparatus.

(3) The head maintenance unit is moved to a position beneath the paper ejection path necessary for the recording medium conveying or the conveyance path to the both surface recording section, and located aside the retraction position of the belt conveying unit for conveying the recording medium in the state where the recording medium is opposed to the recording heads, and is stored at the position, whereby it becomes possible to store the head maintenance unit at such a position that jam removal to be performed under the recording heads is enabled without any hindrance thereto.

(4) The head maintenance unit is stored in a state where the head maintenance unit is covered at an upper part thereof with the cap arrangement side thereof being the inside, whereby it is possible to make the structure of the head maintenance unit a structure in which dust particles hardly adhere to the inside of each of the caps.

(5) The head maintenance unit is stored in a state where the unit is inclined, whereby it becomes possible to cause ink accumulated in the cap to flow out due to the inclination, as a result, wash away dust particles in the cap, and prevent, when the head is to be sealed by the cap, the ink in the cap from coming into contact with the nozzle.

(6) Even when there is no pumping means for sucking ink in the cap, the above-mentioned advantages can be obtained.

(7) The head maintenance unit is retracted and stored in the state where the unit is inclined in the recording medium conveying direction, whereby it is made possible to easily collect ink inside the unit.

(8) Even when capping is performed by using sealing caps in each of which no hole is opened, it becomes possible to drop ink inside the caps to the outside. Further, the nozzle holes are sealed at the time of capping, and hence the internal moisture retention can be enhanced.

(9) Capping is performed by using sealing caps in each of which no hole is opened, retraction of the head maintenance unit is performed, at the time of the next recording operation, in the state where the caps are inclined, and ink inside the recording head modules is circulated, whereby it is possible to realize removal of ink inside the caps and removal of air bubbles inside the recording heads, and improvement in the moisture retention at the time of capping.

(10) The inclination angle of the head maintenance unit is set at such an angle that when ink drops downwardly from the sealing cap, the ink does not drop into a cap of a different color, and drains through which ink is dropped from the cap are provided at lower positions in the cap in the direction of the gravitational force, whereby inks of different colors are not mixed with each other via the caps.

What is claimed is:

1. An image forming apparatus equipped with a maintenance mechanism comprising:

a recording head group including a plurality of recording heads in a first direction;

a recording medium conveying mechanism which conveys a recording medium on a conveyance path in a state where the mechanism is opposed to the recording head group;

an ink supply route for supplying ink to the recording head group;

a plurality of sealing members to be in contact with nozzle surfaces in each of which an ink ejection nozzle of each of the recording heads is formed, and arranged in the first direction; and a holding member which holds the plural sealing members divided into groups, which can be moved at a position or positions between the groups so as to be folded into an accordion-shape, and which is configured to be able to be moved between a nozzle surface sealing position, and a retraction position at which the holding member is stored beneath the conveyance path so as to be stored, and which is in an expanded state in the sealing position, and which is in a folded state in the retraction position.

2. The image forming apparatus according to claim 1, wherein the holding member includes at least two ink pans each of which is formed into a tray-like shape, and the ink pans are coupled to each other by means of pins at an edge of each of the ink pans so as to be bendable.

3. The image forming apparatus according to claim 1, wherein at the retraction position, the sealing members are inclined in a retraction direction.

4. The image forming apparatus according to claim 3, wherein at the retraction position, the sealing members are also inclined in a direction perpendicular to the retraction direction.

5. The image forming apparatus according to claim 4, wherein when the sealing members are inclined at the retraction position, the holding member is bent into at least one V-shape.

6. The image forming apparatus according to claim 1, wherein the movement of the holding member between the sealing position and the retraction position is performed by means of a rack-and-pinion mechanism.

7. The image forming apparatus according to claim 1, wherein the sealing member includes:

a sealing section having a suction hole within sealing a part around the ink ejection nozzle upon the sealing section being positioned the sealing position; and a positioning member formed on the periphery of the sealing section as a tapered projection, and fitted on the periphery of the nozzle surface.

8. The image forming apparatus according to claim 1, further comprising an ejection restoring section which extrudes ink from the ink ejection nozzle of the print head so as to restore the ejection of ink, wherein the ejection restoring section is provided in the plural sealing members, and includes a sucking section which sucks ink and the like inside the sealed space when the sealing member is brought into contact with the recording head, and a suction hole provided in the sealing member, and the holding member is at the sealing position when an ejection restoring operation is performed, and is moved to the retraction position after the operation is completed.

9. The image forming apparatus according to claim 1, further comprising an ejection restoring section which extrudes ink from the ink ejection nozzle of the print head so as to restore the ejection of ink, wherein the ejection restoring section is a pressurizing section which extrudes ink inside the recording heads from the inside to the outside of the recording heads by pressurization, and the holding member is at a position beneath the recording head group when an ejection restoring operation is performed by the pressurizing operation, and is moved to the retraction position after the pressurizing operation is completed.

10. The image forming apparatus according to claim 1, further comprising an ink circulation path for returning ink from the recording heads to the ink supply route, wherein when the holding member is moved from the retraction position to the sealing position, ink inside the recording heads is circulated by way of the ink circulation path.

11. The image forming apparatus according to claim 10, wherein the ink is circulated through the ink circulation path at least immediately after the sealing members seal the nozzle surfaces or immediately after the sealing members are stored from the nozzle surfaces.

12. An image forming apparatus equipped with a maintenance mechanism comprising:

a recording head group in which a plurality of recording heads which ejects ink from nozzles toward a recording medium being conveyed so as to form an image is arranged;

a conveying mechanism which conveys the recording medium through a predetermined conveyance path; and a maintenance mechanism that moves a holding member to which sealing members which seal the nozzles of the recording heads are fixed, and which holding member is divided into a plurality of sections so as to be folded between a sealing position and a retraction position, wherein the sealing position is a position the sealing members seal the nozzles with the holding member being in an expanded state, and the retraction position is a position at which the holding member is stored beneath the conveyance path in a folded state where the sealing members are opposed to each other in an inclined manner between the sections of the holding member.

* * * * *